US007237861B2

(12) United States Patent
Suzuki et al.

(10) Patent No.: US 7,237,861 B2
(45) Date of Patent: Jul. 3, 2007

(54) INKJET PRINTER

(75) Inventors: Yoshiyuki Suzuki, Iruma (JP); Takeo Arai, Hachioji (JP)

(73) Assignee: Konica Corporation, Tokyo (JP)

( * ) Notice: Subject to any disclaimer, the term of this patent is extended or adjusted under 35 U.S.C. 154(b) by 163 days.

(21) Appl. No.: 11/086,502

(22) Filed: Mar. 22, 2005

(65) Prior Publication Data

US 2005/0162451 A1 Jul. 28, 2005

Related U.S. Application Data

(63) Continuation of application No. 10/346,467, filed on Jan. 17, 2003, now Pat. No. 6,902,249.

(30) Foreign Application Priority Data

Jan. 25, 2002 (JP) ..... 2002-017253
Apr. 10, 2002 (JP) ..... 2002-107723

(51) Int. Cl.
*B41J 2/205* (2006.01)

(52) U.S. Cl. ..... 347/15; 347/95

(58) Field of Classification Search ..... 347/15
See application file for complete search history.

(56) References Cited

U.S. PATENT DOCUMENTS 4,528,576 A 7/1985 Koumura et al.
4,593,295 A 6/1986 Matsufuji et al.
4,630,076 A 12/1986 Yoshimura
5,997,132 A 12/1999 Smith et al.
6,084,619 A 7/2000 Takemoto et al.
6,102,536 A 8/2000 Jennel
6,344,819 B1 2/2002 Pond
2001/0020964 A1 9/2001 Irihara et al.

FOREIGN PATENT DOCUMENTS

JP 2001-187464 7/2001
WO WO 96/34763 A1 11/1996

*Primary Examiner*—Thinh Nguyen
(74) *Attorney, Agent, or Firm*—Frishauf, Holtz, Goodman & Chick, P.C.

(57) ABSTRACT

An inkjet printer having, a white color head to jet a white color ink; a plurality of process color heads to jet respective process color inks; and a controller to control operations of the white color head and the plurality of process color heads, wherein the controller selectively conducts a control of a top face printing where at least one of the plurality of the process color heads jets the respective process color ink after the white color head jets the white color ink, or a control of a bottom face printing where the white color head jets the white color ink after at least one of the plurality of the process color heads jets the respective process color ink.

8 Claims, 11 Drawing Sheets

INKJET PRINTER

CROSS-REFERENCE TO RELATED APPLICATION

The present application is a continuation application of U.S. application Ser. No. 10/346,467, now U.S. Pat. No. 6,902,249, filed Jan. 17, 2003.

BACKGROUND OF THE INVENTION

The present invention relates to an inkjet printer.

When the color printing is conducted on a resin package material, mainly, the printing is conducted by the gravure printing. The gravure printing is a printing system by which the ink is put in a concave portion formed on a printing plate and this is directly transferred onto a recording medium, and it has the features in which the character, symbol and picture can be colorfully expressed, and the high speed printing can be conducted on a plenty of recording media. Herein, for example, when the printing is conducted on a transparent package material, in order to maintain the durability to the rubbing of the printing surface, there is a case that the printing is conducted on the bottom face of the package material, and this is called "bottom face printing". Further, it is needless to say, when the printing is conducted on the opaque package material, the printing is conducted on the top face of the package material, and this is called "top face printing".

Meanwhile, to the transparent packing material, for example, there is a case where the character, symbol and picture are printed by making the special color such as white color the background color. In this case, when the bottom face printing is conducted, each color ink of each color is previously printed, and after that, for example, the white color ink may be printed, further, when the top face printing is conducted, the white color ink is previously printed, and after that, each color ink of each color may be printed.

However, with regard to the printing of the character, symbol and picture in which the special color such as the white color is the background color to the packing material as described above, although the gravure printing is a useful printing technology having the above-described features, in the pre-processing by which the printing is practically conducted, it is necessary to make a plate, and it takes much cost and times to produce this plate. Accordingly, when the printing of a small amount and many kinds of products is conducted, it is considered to be preferable that the printing is conducted by using the inkjet printer which does not need the plate, and the inkjet printer which can conduct the printing corresponding to the transparent or opaque packing material on a case-by-case basis, is desired.

Accordingly, the object of the present invention is to provide an inkjet printer by which the printing can be conducted corresponding even to the transparent or opaque resin made packing material, on a case-by-case basis.

SUMMARY OF THE INVENTION

The structures to solve the above-described problem are as follows.

(1) An inkjet printer provided with a plurality of heads to jet the ink, and a carriage on which the plurality of heads are mounted, the inkjet printer is characterized in that: in the plurality of heads, there is a white color head to jet a white color ink, and a process color head to respectively jet each color ink of the process colors; and a control means (controller) is provided for selectively controlling whether, after the white color ink is jetted from the white color head, the process color ink is jetted from at least one process color head in respective process color heads to conduct the top face printing, or after the process color ink is jetted from at least one process color head in respective process color heads the white color ink is jetted from the white color head to conduct the bottom face printing.

In the inkjet printer described in (1), the top face printing by which the white color printing is previously conducted by the white color head, and then, each color printing is conducted by each of the process color heads, can be conducted, and further, the bottom face printing by which the printing of each color is previously conducted by the each of the process color heads, and then, the printing of the white color is conducted by the white color head, can also be conducted. Then, in the above-described structure, either one of whether the top face printing is conducted, or the bottom face printing is conducted, can be selected by the control means and can be printed. Accordingly, for example, when the printing in which the background color is white to the transparent recording medium, is conducted, the bottom face printing can be selectively conducted by the control means, on the one hand, when the printing in which the background color is white to the opaque recording medium, is conducted, the top face printing can be normally conducted selectively by the control means. According to this, the printing can be conducted corresponding to various recording media on a case-by-case basis.

In addition, relating to the description of (1), "after the ink is jetted from the white color head, the ink is jetted from at least one process color head in respective process color heads" does not means that, after the white color printing is conducted over the entire area of the printing area of the recording medium, the printing by at least one color in respective process colors is conducted, but means that, with regard to an arbitrary area in the printing area, the white color printing is previously conducted in this arbitrary area, and then, the printing by at least one color in respective process colors is conducted. Accordingly, when the entire area of the printing area of the recording medium is observed, the white color printing and the printing by at least one color in respective process colors are repeatedly conducted.

Further, in the same manner, "after the ink is jetted from at least one process color head in the process color heads, the ink is jetted from the white color head" does not means that, after the printing by at least one color in respective process colors is conducted over the entire area of the printing area of the recording medium, the white color printing is conducted, but means that, with regard to an arbitrary area in the printing area, the printing by at least one color in respective process colors is previously conducted on this arbitrary area, and the white color printing is conducted after that. Accordingly, when the entire area of the printing area of the recording medium is observed, the printing by at least one color in respective process colors and the white color printing are repeatedly conducted.

(2) In the inkjet printer described in (1), the inkjet printer is characterized in that: white color heads and each of the process color heads are mounted on a single carriage; and the white color heads are arranged at portions mutually separated to at least 2 portions of the carriage, and between these white color heads, each of the process color heads is arranged.

In the invention of (2), as the simplest arrangement of the white color heads, (i) a case where the white color heads are arranged along the movement direction of the carriage, and (ii) a case where the white color heads are arranged along the direction which crosses the movement direction of the carriage, are considered.

(i) In a case where the white color heads are arranged along the movement direction of the carriage, for example, when the white color heads are respectively arranged on the both ends of each of process color heads along the movement direction of the carriage, accompanied by the movement of the carriage, the white color head in the front side of the movement direction is moved on the printing surface of the recording medium before each of the process color heads, and the white color head on the rear side is moved on the printing surface of the recording medium after each of the process color head. In this case, the white color printing can be conducted by the white color head on the front side before each of the process color heads, further, the white color printing can be conducted by the white color head on the rear side after each of the process color heads. Furthermore, in this case, the printing is not conducted by moving the carriage again on the printing surface of the recording medium on which the carriage is moved once, but the white color printing can be conducted also before and after each of the process color heads by the white color heads on the front side and rear side by one time carriage movement. Accordingly, in the printing in which the background color is white, by a simple structure in which the white color head and each of the process color heads are mounted on the single carriage, and the arrangement of these heads is considered, the same effect as (1) can be attained.

On the one hand, (ii) a case where the white color heads are arranged along the direction which crosses the movement direction of the carriage, for example, when the white color head is arranged on the front side and rear side of the transport direction of the recording medium, and each of the process color heads is arranged between the white color heads on the front side and rear side, the white color head on the rear side is initially moved on the printing surface of the transported recording medium, and after that, each of the process color heads is moved on the printing surface of the recording medium on which the white color head on the rear side passes, and further after that, the front side white color head is moved on the printing surface of the recording medium on which each of the process color heads passes. In this case, by the white color head on the rear side, the white color printing can be conducted before each of the process color heads, further, by the white color head on the front side, the white color printing can be conducted after each of the process color heads. Furthermore, in this case, the printing is not conducted by moving the carriage again on the printing surface of the recording medium on which the carriage is moved once, but the white color printing can be conducted also before and after each of the process color heads by the white color heads on the front and rear sides by the one time carriage movement. Accordingly, in the same manner as (i), in the printing whose background color is white, by a simple structure in which the white color head and each of the process color heads are mounted on the single carriage, and the arrangement of these heads is considered, the same effect as (1) can be attained.

(3) In the inkjet printer described in (2), the inkjet printer is characterized in that: the white color heads are arranged at 2 portions whose interval is spaced along the movement direction of the carriage.

According to the invention described in (3), the same effect as the description of (i) relating to (2) is attained.

(4) In the inkjet printer described in (2), the inkjet printer is characterized in that: the white color heads are arranged at two portions whose interval is spaced along the direction crossing the movement direction of the carriage.

According to the invention described in (4), the same effect as the description in (ii) relating to (1) is attained.

(5) In the inkjet printer described in (1), the inkjet printer is characterized in that: the white color head and each of the process color heads are mounted on the single carriage along the movement direction of the cartridge, and one white color head is arranged at one of rear side or front side of each of the process color heads along the movement direction of the carriage.

Basically, because the carriage is reciprocally moved, for example, in the case where, to each of the process color heads, when the white color head is arranged on the front side of the outward direction in the movement directions of the carriage, when the carriage moves along the outward direction, the white color head is moved on the printing surface of the recording medium before each of the process color heads and by this white color head, the printing of the white color can be conducted before each of the process color heads. Further, when the carriage is moved along the homeward direction, this white color head is moved on the printing surface of the recording medium after each process carriage, and by this white color head, the printing of the white color can be conducted after each of the process color heads. Accordingly, in the single direction printing by which the ink is jetted from each head only when the carriage is moved along either direction of the outward direction or homeward direction, the top face printing and the bottom face printing whose background color is white can be conducted.

(6) In the inkjet printer described in (5), the inkjet printer is characterized in that: in the case where the carriage is reciprocally moved along the movement direction, when the carriage is turned back from the outward direction to the homeward direction, and from the homeward direction to the outward direction, it is rotated by 180°.

For example, in the case where, to each of the process color heads, the white color head is arranged on the front side in the outward direction in the movement directions of the carriage, when the carriage is moved along the outward direction, this white color head is moved on the printing surface of the recording medium before each of the process color heads. Then, in the invention described in (6), because, when the carriage changes the movement direction from the outward direction to the homeward direction, it is turned by 180°, also when the carriage is moved along the homeward direction, this white color head is positioned on the front side of the homeward direction to each of the process color heads, and is moved on the printing surface of the recording medium before each of the process color heads. Furthermore, because the carriage is rotated by 180° also when it changes the movement direction from the homeward direction to the outward direction, the white color head is positioned on the front side of the outward direction to each of the process color heads, and is moved on the printing surface of the recording medium before each of the process color heads.

That is, in the invention described in (6), because the carriage is rotated by 180° when it changes the movement direction, to each of the process color heads, when the white color head is arranged on the front side of the movement direction of the carriage, the white color head is always positioned on the front side of the movement direction and moved on the printing surface of the recording medium before each of the process color heads. In this case, the white color printing can be conducted by this white color head before each of the process color heads.

Inversely, when white color head is arranged on the rear side of the movement direction of the carriage to each of the process color heads, the white color head is always positioned on the rear side of the movement direction of the carriage, and moved on the printing surface of the recording medium after each of the process color heads. In this case, the white color printing can be conducted after the each of the process color heads by this white color head.

Accordingly, to each of the process color heads, by arranging the white color head on the front side of the movement direction or the rear side thereof, the top face printing and the bottom face printing of the two-way printing can be conducted.

Meanwhile, in the invention described in (6), although "the carriage is rotated by 180° when it turns back from the outward direction to the homeward direction and from the homeward direction to the outward direction", the time to conduct the rotating motion of the carriage may be widely understood. That is, when it is an area except the image formation area in the recording medium, while the carriage is positioned just on the recording medium (for example, the end portion of the recording medium), it may also be rotated by 180°, or while it is not positioned just on the recording medium, the carriage may also be rotated by 180°. Further, in this case, the carriage may also be rotated by 180° while it is being moved, or in the status in which the movement is stopped.

(7) In the inkjet printer described in any one of (1)–(6), the inkjet printer is characterized in that: further having a single carriage which is mounted with one or plural white color heads and the plurality of the process color heads, wherein the interval between any one of the plurality of the process color heads and the white color head adjoining the one of the process color heads is larger than at least one of an interval between each of the plural white color heads and an interval between each of the plurality of process color heads.

Herein, in the white color head and the process color head, the inks whose types are respectively different can be jetted, for example, in the white color head and process color head, it can also be conducted that the inks whose heating temperature are respectively different are jetted. In this case, because the temperature difference is generated in the heating temperature of the ink in between the process color head adjoining the white color head in respective process color heads, and the white color head, there is a possibility that the influence of the temperature difference is subjected between respective heads. When the influence of the temperature difference is subjected between respective heads, it is not preferable in the point that the ink is jetted from each head at the optimum heating temperature. Herein, in the invention described in (7), when the white color head is divided into a plurality of white color divided heads, the interval between respective white color divided heads is smaller than the interval between the white color head and the process color head which respectively adjoin. Accordingly, the mutual white color divided heads in which the heating temperature of the inks is same are in the dense status, and the white color head can be downsized (the homogenization of the heating temperature of the white color ink can be attained). Further, in this invention, even when at least one process color head in respective process color heads is divided into a plurality of process color divided heads, the interval between respective process color heads is smaller than the interval between the white color head and the process color head which respectively adjoin, and further, the interval between the process color heads which each of the process color heads respectively adjoins, is also smaller than the interval between the white color head and the process color head which respectively adjoin. Accordingly, the mutual process color divided heads in which the heating temperature of the ink is same, furthermore, mutual process color heads are in more dense status, and the downsizing of the whole of process color heads in which all of process color heads are integrated can be attained (the homogenization of the heating temperature of the process color ink can be attained). In this connection, the interval between the process color head adjoining the white color head in respective process color heads, and the white color head, may also be larger than all of these three intervals of the interval between the white color divided heads, the interval between respective process color divided heads, and the interval between the process color heads which respectively adjoin.

From these matters, according to the invention described in (7), when the inks whose heating temperature are respectively different are jetted by the white color head and the process color head, as described above, because each head is respectively downsized, one side head is hardly influenced by the temperature difference from the other hand head whose heating temperature is different. Thereby, the ink can be jetted at the optimum heating temperature from each head.

(8) The inkjet printer provided with a plurality of heads to jet the ink, and the carriage on which the plurality of heads are mounted, the inkjet printer is characterized in that: in the plurality of heads, there are the white color head to jet the white color ink, and each of the process color heads to respectively jet each color ink of the process color; the white color head and each of the process color heads are mounted on a single carriage; by the movement of the head by the carriage and the movement of the recording medium onto which the ink is jetted from the head, the image (the character, symbol and picture are included hereinafter, that is same.) is successively formed on the recording medium; and when each head passes only once on a predetermined area of the recording medium and the ink is jetted on the predetermined area, the white color heads are arranged on a position on the carriage which can jet the ink before each of the process color heads, and on a position on the carriage which can jet the ink after each of the process color heads.

According to the invention described in (8), when the movement of the head by the carriage and movement of the recording medium are conducted and each head passes on the predetermined area of the recording medium and jets the ink, because the white color heads are arranged at positions at which the ink can be jetted always before and after each of the process color heads, in this case, the white color printing can be conducted before each of the process color heads, and the white color printing can also be conducted after each of the process color heads. Further, in this case, the printing is not conducted by moving the carriage again on the predetermined area of the recording medium on which the carriage moves once, but by the one-time movement of the carriage, the white color printing can be conducted also before and after each of the process color heads by the white color head. Accordingly, in the printing in which the background color is white, for example, to the transparent recording medium, the bottom face printing can be selectively conducted, and for example, to the opaque recording medium, the top face printing can be selectively conducted in the normal manner. Thereby, the printing can be conducted corresponding to various recording media on a case-by-case basis.

(9) In the inkjet printer described in any one of (1) to (8), the inkjet printer is characterized in that: the ink to be jetted from each head of the white color head and each of the process color heads is jetted as an ink drop; and the jetted amount per one drop of the ink drop jetted from the white color head is greater than the jetted amount per one drop of the ink drop jetted from each of the process color heads.

In the invention described in (9), because the jetted amount per one drop of the ink drop jetted from the white color head is greater than the jetted amount per one drop of the ink drop jetted from each of the process color heads, when the ink drop is jetted by one drop from each head onto the recording medium, the occupancy area of the ink drop from the white color head occupied on the recording medium is larger than the occupancy area of the ink drop from each of the process color heads. Accordingly, when several ink drops are respectively continuously jetted onto the recording medium from the white color head and each of the process color heads, because the gap of each ink drop from the white color head is smaller than the gap of each ink drop from each of the process color heads, the unevenness or moire of the ink drop of the background color formed by the white color head can be suppressed.

(10) In the inkjet printer, the ink of the white color and the ink of each process color may also be the UV ink, which is hardened by the irradiation of the ultraviolet ray.

(11) In the inkjet printer, the ink of the white color and the ink of each process color may also be any one of the aqueous ink, oil-based ink, solvent ink, and solid ink. In this connection, the coloring agent used for "aqueous ink" and "oil-based ink" may also be the pigment or dye.

(12) In the inkjet printer, the recording medium on which the image is recorded by the ink of the white color and the ink of each process color may also be a transparent or translucent resin film. In this case, because the recording medium is a transparent or translucent medium, not only the top face printing but also the bottom face printing can be conducted. In this connection, as the resin of "resin film", PET (polyethylene terephthalate), PS (polyester), or PP (polypropylene) is preferably used.

(13) The inkjet printer provided with a plurality of heads to jet the ink and a carriage on which a plurality of heads are mounted, the inkjet printer is characterized in that: in the plurality of heads, there are a special color head to jet a special color ink, and each of the process color heads to respectively jet each color ink of the process colors; and the control means (controller) is provided for selectively controlling whether, after the special color ink is jetted from the special color head, the process color ink is jetted from at least one process color head in the process color heads to conduct the top face printing, or whether, after the process color ink is jetted from at least one process color head in the process color heads, the special color ink from the special color head is jetted to conduct the bottom face printing.

(14) In the inkjet printer described in (13), the inkjet printer is characterized in that: special color heads and each of the process color heads are mounted on a single carriage; the special color heads are arranged at portions respectively separated at least in two portions of the carriage; and each of the process color heads is arranged between these special color heads.

(15) In the inkjet printer described in (14), the inkjet printer is characterized in that: special color heads are arranged at two portions whose interval is spaced, along the movement direction of the carriage.

(16) In the inkjet printer described in (14), the inkjet printer is characterized in that: the special color heads are arranged at two portions whose interval is spaced, along the direction crossing the movement direction of the carriage.

(17) In the inkjet printer described in (13), the inkjet printer is characterized in that: the special color head and each of the process color heads are mounted on the single carriage along the movement direction of the cartridge, and one special color head is arranged at one of rear side or front side of each of the process color heads along the movement direction of the carriage.

(18) In the inkjet printer described in (17), the inkjet printer is characterized in that: when the carriage is reciprocally moved along the movement direction, the carriage is rotated by 180° when it turns back from the outward direction to the homeward direction and from the homeward direction to the outward direction.

(19) In the inkjet printer described in any one of (13) to (18), the inkjet printer is characterized in that: the inkjet printer, further comprising:

a single carriage which is mounted with one or plural special color heads and the plurality of the process color heads, wherein the interval between any one of the plurality of the process color heads and the special color head adjoining the one of the process color heads is larger than at least one of an interval between each of the plural special color heads and an interval between each of the plurality of process color heads.

(20) The inkjet printer provided with a plurality of heads to jet the ink, and the carriage on which the plurality of heads are mounted, the inkjet printer is characterized in that: in the plurality of heads, there are the special color ink to jet the special color ink, and respective process color heads to respectively jet each color inks of the process colors; the special color head and each of the process color heads are mounted on a single carriage; the image is successively formed on the recording medium by the movement of the heads by the carriage, and the movement of the recording medium onto which the ink is jetted from the head; and when each head passes only once on a predetermined area of the recording medium and the ink is jetted onto the predetermined area, the special color heads are arranged at the position on the carriage at which the ink can be jetted before each of the process color heads, and at the position on the carriage at which the ink can be jetted after each of the process color heads.

(21) In the inkjet printer described any one of (13) to (20), the inkjet printer is characterized in that: the ink to be jetted from each head of the special color head and each of the process color heads is jetted as an ink drop; and the jetted amount per one drop of the ink drop is larger than the jetted amount per one drop of the ink drop jetted from each of the process color heads.

In the invention of (13) to (21), "the white color" described in (1) to (9) can be read by replacing with "the special color (excepting the white color)". Accordingly, each invention of (13) to (21) can attain the same advantageous effect as each invention of (1) to (9).

(22) In the inkjet printer, the special color ink and the ink of each process color may also be the UV ink which is hardened by the irradiation of the ultraviolet ray.

(23) In the inkjet printer, the ink of the special color and the ink of each process color may also be any one of the aqueous ink, oil-based ink, solvent ink, and solid ink. In this connection, the coloring agent used for "aqueos ink" and "oil-based ink" may also be pigment or dye.

(24) In the inkjet printer, the recording medium on which the image is recorded by the ink of the special color ink and the ink of each process color may also be a transparent or translucent resin film. In this case, because the recording medium is a transparent or translucent medium, not only the top face printing but also the bottom face printing can be conducted. In this connection, as the resin of "resin film", PET (polyethylene telephthalate), PS (polyester), or PP (polypropylene) is preferably used.

In this connection, in the present specification, the "process color" means the color ink of at least Y (yellow), M (magenta), C (cyan), and K (black). Except for them, when the head to jet the color ink of LM (light magenta) or LC (light cyan), or further, the head to jet the color ink of LK (light black) or LY (light yellow) are mounted on the carriage, and these color inks are used, it is preferable that these color inks are also included in the process color of the present invention.

In the present specification, the "white color" means the color whose color indication in a*b* plane of Lab system is on or inside the circle with radius 20, and the hue range is not less than 70 in L* value, when an object to be measured is measured by using calorimeter CM2022 (made by Minolta Corp.) with irradiating light from a light source D50, and measuring mode of viewing field 2°.

Further, in the present specification, the "special color" is the color except each process color of the "process color" and the color in which the process colors are combined, and means the color in which each process color (white, transparent, gold, silver, blue, green, red, russet, khaki, or crimson) can not express or even when respective process colors are combined, it can not express.

Further, in the present specification, the "head" is provided with a plurality of nozzles, and from each nozzle, the same color ink is jetted as an ink drop. Of course, the number of nozzles provided in the "head" can be appropriately changed. Further, the "head" may also be divided into a plurality of heads for each of nozzles of a predetermined number. When the "head" is divided in this manner, each of a predetermined number of divided nozzles is grasped as a divided head, and it may be understood that the "head" is composed of a plurality of divided heads. Of course, the number of nozzles of the divided head may be the same, or different.

DETAILED DESCRIPTION OF THE PREFERRED EMBODIMENT

Figure 1:
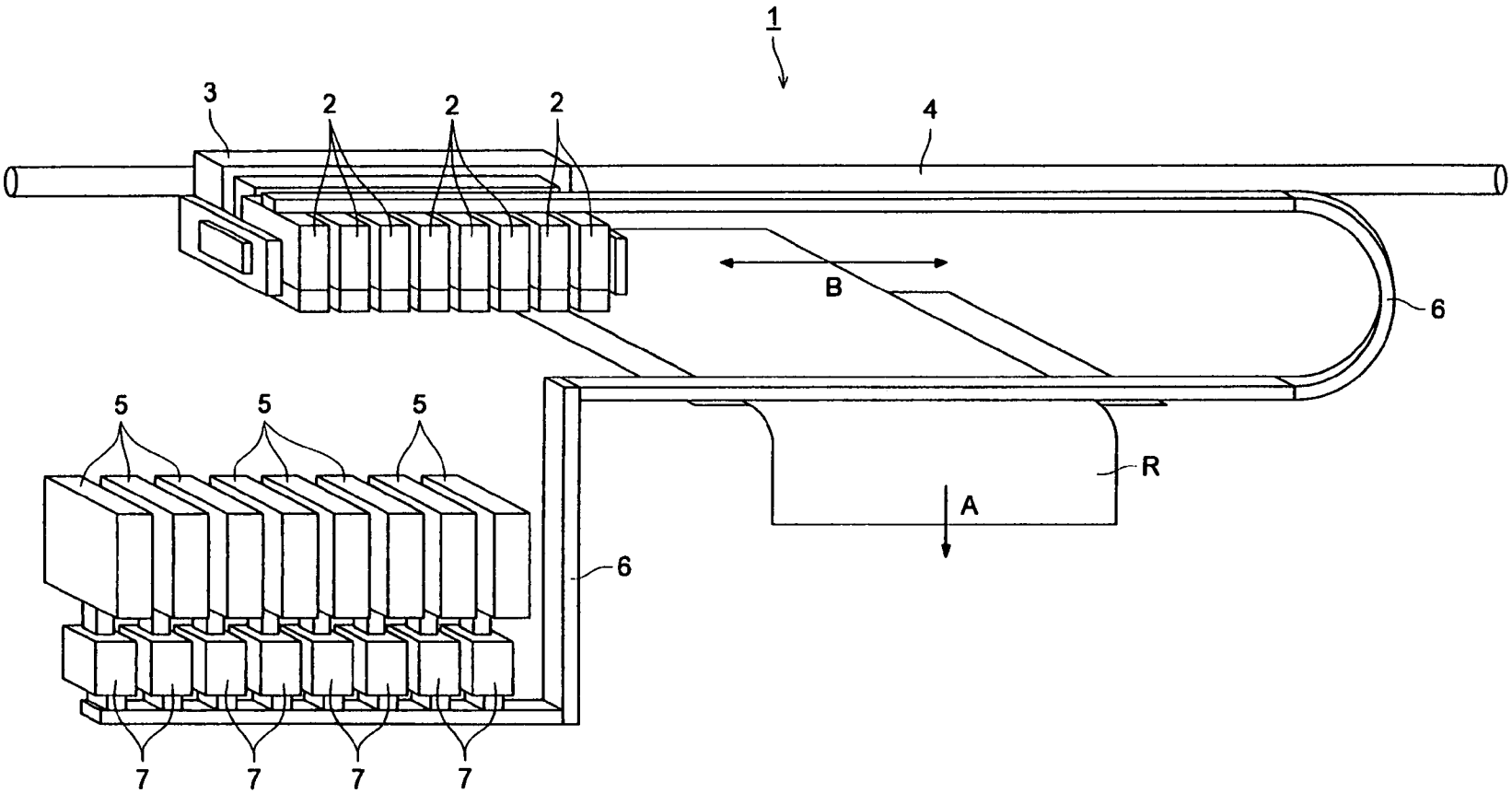
FIG. 1 is a main portion sketch drawing showing an inkjet printer according to the present embodiment.

Referring to the drawings, an embodiment according to an inkjet printer of the present invention will be described below.

Figure 2:
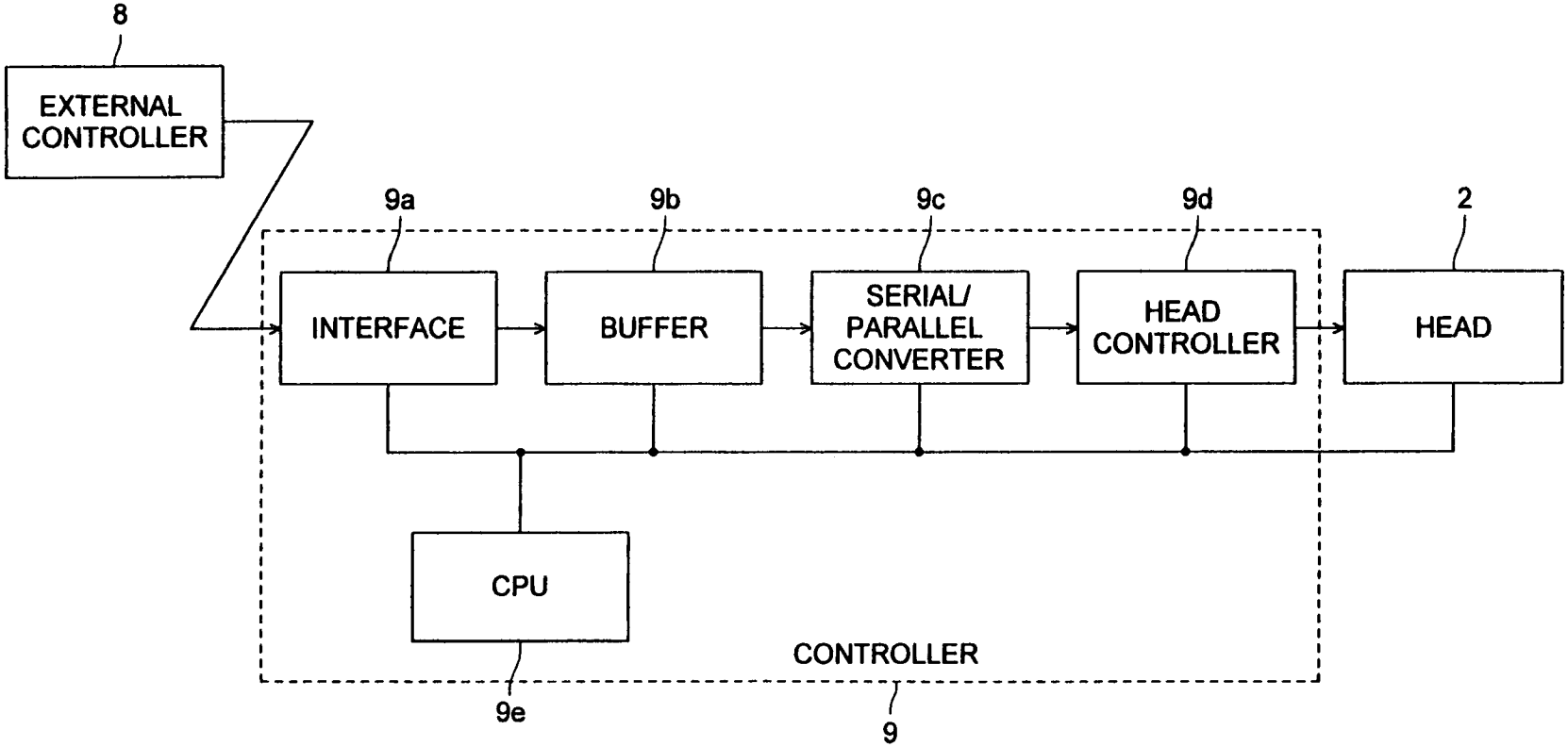
FIG. 2 is a block diagram showing a controller according to the present embodiment.

As shown in FIG. 1, the inkjet printer 1 (hereinafter, called "printer 1") is provided with, as its main structure: a transport means (not shown) for transporting a recording medium R along a transport direction A; a plurality of heads 2, 2, . . . to jet the ink onto the recording medium R; a carriage 3 on which the plurality of heads 2, 2, . . . are mounted; a guide rail 4 to guide the carriage 3 along the movement direction B at the time of the printing; a plurality of ink tanks 5, 5, . . . in which each color ink to be supplied to each head is accommodated; and an ink supply route 6 to supply each color ink from each ink tank 5 to each head 2. Further, as shown in FIG. 2, on the outside of the printer 1, an external controller 8 to output the image data of the image to be printed, and the control data is provided, and in the inside of the printer 1, a control device 9 to process the data inputted from the external controller 8 is provided.

In addition, in the present embodiment, it is supposed that the recording medium R is a transparent recording medium, and the following description is conducted, however, it is not limited to the transparent recording medium, but such as a translucent recording medium, or an opaque recording medium or the other recording medium on which the printing can be conducted by the printer 1, can be applied regardless to their kinds. Further, relating to the material of the recording medium R, the resin is not limited, paper or the other material on which the printing can be conducted by the printer 1, can be applied. Accordingly, it is needless to say that the transparent or translucent resin film is also the recording medium which can be applied.

The transport means, although it is not detailed, has the function by which the recording medium R is transported along the transport direction (refer to an arrow A in FIG. 1) at the time of the printing.

The head 2 is a part to jet the ink onto the recording medium R. A plurality of the heads 2 is mounted on the carriage 3 corresponding to the kind of the ink to be used in the printer 1. In this connection, the "head 2" is largely divided into (i) the white color head to jet the white color ink of W: white, and (ii) each of the process color heads to jet each process color ink of LY: light yellow, Y: yellow, LM: light magenta, M: magenta, LC: light cyan, C: cyan, LK: light black, and K: black (refer to FIG. 3, FIG. 5, FIG. 7, FIG. 9 and FIG. 10). Further, the white color ink jetted from the white color head and each process color ink jetted from each of the process color heads are the UV ink which is hardened when the ultraviolet ray (hereinafter, called "UV") is irradiated.

On the carriage 3, a plurality of heads 2, 2, . . . , are mounted, and the carriage 3 is guided by a guide rail 4 and repeats the reciprocal motion along the movement direction (refer to an arrow B in FIG. 1, the direction almost perpendicular to the transport direction A of the recording medium R). In this connection, although the detailed explanation will be described later, in the printer 1 of the present embodiment, the white color head of the plurality of heads 2, 2, . . . , which are mounted on the carriage 3 and each of the process color heads are mounted in a single carriage 3, and the mutual arrangement relationship of the white color head and each of the process color heads in the carriage 3 is a feature.

Each ink tank 5 is a replaceable ink cartridge, and a plurality of ink tanks is provided corresponding to each color of the ink accommodated in each head 2. Each color ink is stored in each ink tank 5.

When the each head 2 and each ink tank 5 are communicated with respective mutually corresponding set depending on the kind of the ink, the supply of the ink from each ink tank 5 to each head 2 can be conducted for each color. The ink supply route 6 is formed of a flexible member so that it can follow the movement of the carriage 3. In this connection, in the ink supply route 6, a variable pressure pump 7 by which the supply of the ink from each ink tank 5 to each head 2 can be conducted, is respectively provided. By each variable pressure pump 7, the pressure inside the ink supply route 6 can be changed, thereby, the ink supply amount from each ink tank 5 to each head 2 can be appropriately changed.

Figure 8:
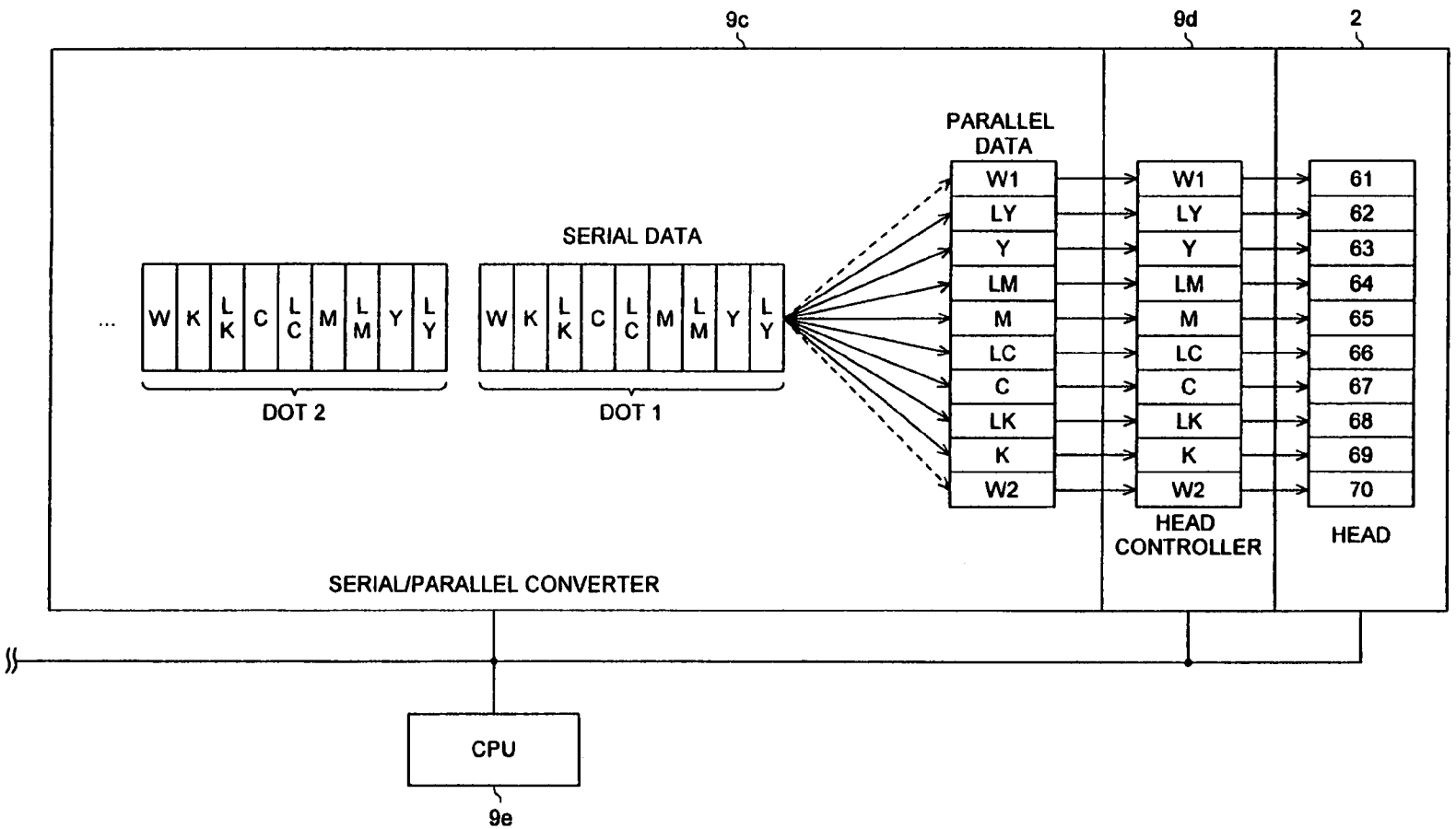
FIG. 8 is a view for explaining the movement of the inside of the control device according to the third mode.

Further, an external controller 8 shown in FIG. 8 is provided outside the printer 1 as described above, and outputs the image data of the image to be printed, and the control data.

The controller 9 is provided with, as its basic structure, an interface 9*a*, buffer 9*b*, serial parallel conversion section (hereinafter, called "converter") 9*c*, head control section 9*d*, and CPU 9*e*.

The interface 9*a* transfers the image data and the control data inputted from the external controller 8 to each section, and outputs the image data to the buffer 9*b*, and the control data to the CPU 9*e*.

The buffer 9*b* is a memory, which is temporarily used for the processing of the image data transferred from the interface 9*a*, and adjusts the image data so that it is synchronized with the printing speed of the printer 1.

The conversion section 9*c* converts the serial image data in plural. In this connection, the detail of this conversion section 9*c* will be described later.

The head control section 9*d* respectively outputs the image data which is converted into parallel by the conversion section 9*c*, to each head 2 of heads provided in plural, 2, 2, . . . .

Then, each head 2 jets each color ink according to the image data inputted from the head control section (head controller) 9*d*.

The CPU 9*e* controls the above-described image data according to the control data inputted from the external controller 8.

Next, referring to FIG. 3 to FIG. 9, the arrangement relationship of the white color head in the plurality of heads 2, 2, . . . , and each of the process color heads mounted on the carriage 3, and the printing movement of the printer 1 in the arrangement relationship will be described.

In this connection, the arrangement of the white color head and each of the process color heads is, generally, largely divided into a case shown in FIG. 3, a case shown in FIG. 5, and a case shown in FIG. 7, and respective cases will be described as the first embodiment, second embodiment and third embodiment.

[The First Embodiment]

Figure 3:
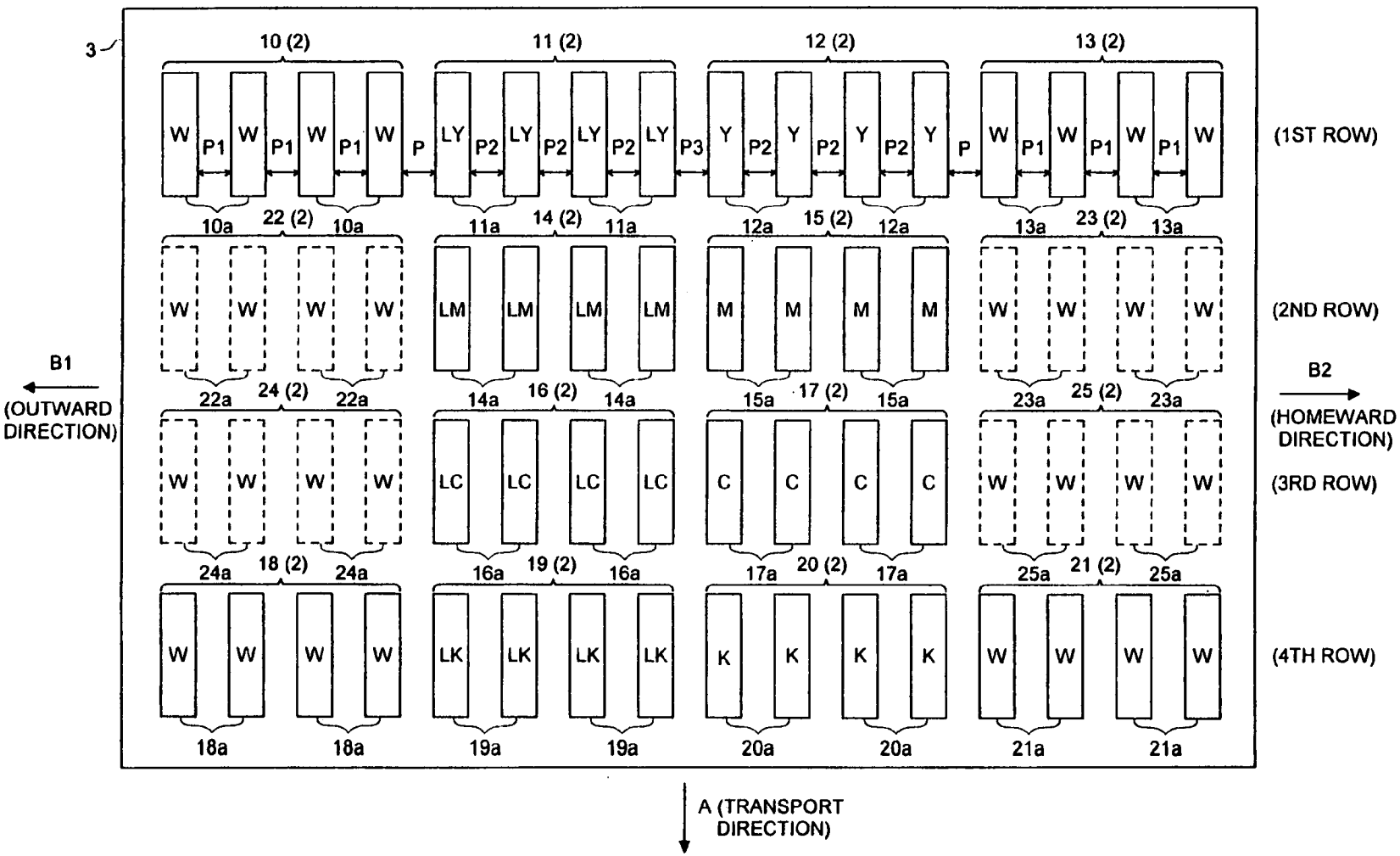
FIG. 3 is a view showing the arrangement relationship of a white color head and each of the process color heads according to the first mode of the present embodiment.

As shown in FIG. 3, a plurality of heads 2, 2, . . . are mounted on the carriage 3. These plurality of heads 2, 2, . . . , are structured by the first–fourth white color heads to jet the white ink 10, 13, 18, 21, and respective process color heads to jet respective process color inks 11, 12, 14, 15, 16, 17, 19, and 20. Then, these plural heads 10–21 are arranged over 4 rows (the first row–fourth row). The specific arrangement of respective row heads is as follows, from the left side in FIG. 3, (1) the first row: the first W head 10, LY head 11, Y head 12, the second W head 13, (2) the second row: LM head 14, M head 15, (3) the third row: LC head 16, C head 17, (4) the fourth row: the third W head 18, LK head 19, K head 20, the fourth W head 21. In this connection, each of heads 10–21 is respectively provided with a plurality of nozzles (not shown), and is divided into 4 divided heads for respective nozzles of a predetermined number (for example, 128 nozzles). For example, when it is described referring to the first W head 10, the first W head 10 is structured by 4 W-divided heads 10*a*, 10*a*, . . . . As for respective heads 11–21 except for the first W head 10, it is also the same.

Figure 4:
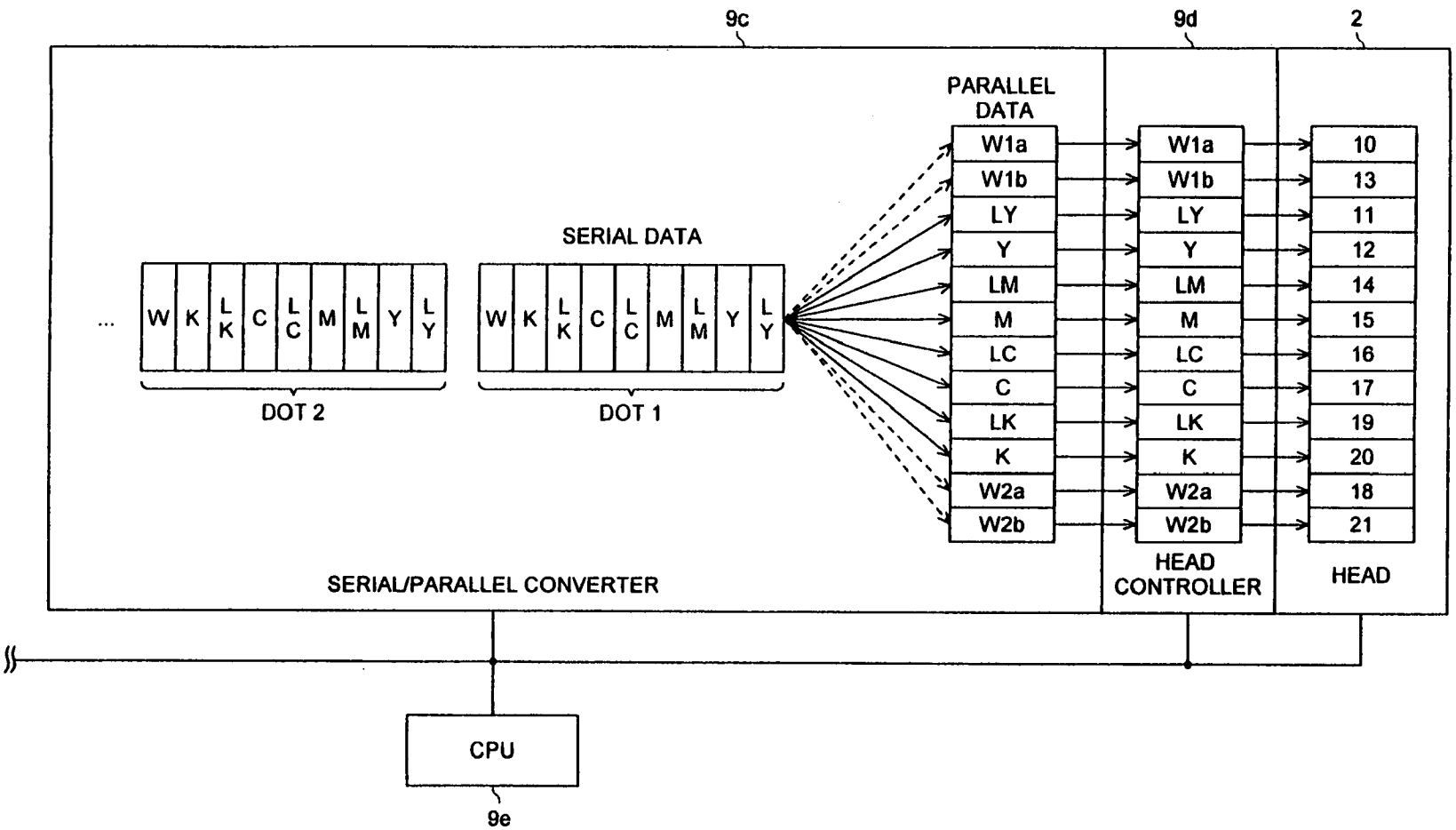
FIG. 4 is a view for explaining the movement of the inside of the control device according to the first mode.

Further, inside the controller 9, as shown in FIG. 4, the image data inputted into the conversion section 9*c* is the serial data for each dot in which each color of the white color and each process color is made one set, and in this conversion section 9*c*, it is converted from the serial data into the parallel data. Specifically, each color data (W, K–LY) for each dot of the serial data is converted into parallel data (W1*a*–W2*b*) corresponding to each color of heads 10–21. Then, the data of each color converted into the parallel data is outputted to the head control section 9*d*, and the head control section 9*d* respectively outputs the drive signal corresponding to each color data to the line connected to each color of heads 10–21, and drives each color of heads 10–21. Then, the ink is jetted from each color of heads 10–21. That is, the each color data of the serial data is converted into the parallel data corresponding to each color of heads 10–21, thereby, it is distributed as the data for each color, and the data distributed into each color is converted into the drive signal and respectively outputted to each color of heads 10–21. In this connection, in more detail, each color data corresponding to the position of each dot is further converted into the drive signal for each nozzle in each color of heads 10–21.

Herein, because the number of the heads for the white color (the first–the fourth W head 10, 13, 18, 21) is 4, relating to the white color data W in the serial data, when it is converted into the parallel data in the conversion section 9*c*, it is distributed to any one of 4 white color data W1*a*–W2*b* corresponding to 4 heads of the first–fourth W head 10, 13, 18, 21 for the white color.

In the case of the top face printing in which the background color is white, the white color data W in the serial data is distributed into any one of the white color data W1*a* and white color data W1*b* of the parallel data, and furthermore, in the case of the two-way printing (the printing to jet the ink during the movement of the outward direction B1 and homeward direction B2 in the reciprocal movement of the carriage 3. Hereinafter, it is the same.), for example, at the time of printing of the outward direction B1, the data is distributed to the white color data W1*a*, and at the time of printing of the home ward direction B2, it is distributed to the white color data W1*b*. In this connection, in the case of the single direction printing (the printing to jet the ink only during the movement of any one direction of the outward direction B1 or homeward direction B2 in the reciprocal movement of the carriage 3. Hereinafter, it is the same.), corresponding to the direction, it is distributed to only either one of the white color data W1*a* or white color data W1*b*.

Further, in the case of the bottom face printing in which the background color is white, the white color data W in the serial data is distributed into any one of the white color data W2*a* and white color data W2*b* of the parallel data, and furthermore, in the case of the two-way printing, at the time of printing in the outward direction B1, it is distributed to the data W2*a*, and at the time of printing in the homeward direction B2, it is distributed to the data W2*b*. In this connection, in the case of the single direction printing, corresponding to the direction, it is distributed to only either one of the data W2*a* or data W2*b*. In this connection, the above-described conversion is conducted by the control of the CPU 9*e* according to the inputted control signal.

Next, the printing movement of the printer 1 when each kind of printing shown in the following (i)–(iv) in the arrangement relationship of the plurality of heads 2, 2, . . . , is conducted, will be specifically described. In this connection, the recording medium R on which the printing is conducted, is transported along the transport direction A, however, in this case, it is transported in a predetermined transport amount determined corresponding to the resolution of the image, and intermittently. That is, the recording medium R is transported while repeating the movement of the predetermined amount in the transport direction and the stoppage.

(i) The Top Face Printing of the Single Direction Printing (the Background Color is White)

(A1) Initially, when the recording medium R is stopped, the carriage 3 standing by at the initial position, moves along the outward direction B1. Herein, in an arbitrary area to be printed, on the arbitrary area, the first row head 2, 2, . . . passes in the order of the first W head 10, LY head 11, Y head 12 and the second W head 13, and the ink is jetted from the first W head 10, LY head 11 and Y head 12 (in this connection, the ink is not jetted from the second W head 13). At this time, inside the controller 9, the CPU 9*e* controls so that the white color data W of the serial data is converted into the white color data W1*a* of the parallel data.

(A2) Then, the carriage 3 moved along the outward direction B1 arrives at the final position in the outward direction B1 and returns to the initial position. In this case, the recording medium R is in the condition that it is stopped.

(A3) After that, the recording medium R moves along the transport direction by a predetermined amount, and stops.

(A4) Then, a series of movements shown in (A1) to (A3) are repeated by adequate times.

(A5) After that, on the arbitrary area shown in (A1), the second row heads 2, 2 pass in the order of LM head 14 and M head 15, and the ink is jetted from the LM head 14 and M head 15.

(A6) Then, a series of movement composed of a predetermined amount of the movement and the stoppage of the recording medium R, and the reciprocal movement toward the outward direction B1 and the homeward direction B2 of the carriage 3, is repeated by adequate times.

(A7) After that, on the arbitrary area shown in (A1), the third row heads 2, 2 pass in the order of LC head 16 and C head 17, and the ink is jetted from the LC head 16 and C head 17.

(A8) Then, a series of movement composed of a predetermined amount of the movement and the stoppage of the recording medium R, and the reciprocal movement toward the outward direction B1 and the homeward direction B2 of the carriage 3, is repeated by adequate times.

(A9) After that, on the arbitrary area shown in (A1), the fourth row heads 2, 2, . . . pass in the order of the third W head 18 and LK head 19, and the fourth W head 21, and the ink is jetted from the LK head 19 and K head 20. (In this connection, the ink is not jetted from the third W head 18 and fourth W head 21.)

(A10) Then, a series of movement composed of a predetermined amount of the movement and the stoppage of the recording medium R, and the reciprocal movement toward the outward direction B1 and the homeward direction B2 of the carriage 3, is repeated by adequate times.

(A11) The movement of above described (A1)–(A10) is conducted, and the printing onto the arbitrary area shown in (A1) is completed.

When the movement as described above is conducted on the recording medium R, the top face printing (the background color is white) of the single direction printing can be conducted. That is, in this case, the CPU 9*e* converts the white color data W of the serial data into the white color data W1*a* of the parallel data, and the white color ink is initially jetted by the first W head 10, and after that, each process color ink is jetted by each of process color heads of LY head 11–K head 20.

(ii) The Bottom Face Printing of the Single Direction Printing (the Background Color is White)

It is almost the same as the case of the top face printing of the above-described (i), the single direction printing. The different point is that the jetting of the ink from the first W head 10 and the second W head 13 of the first row, and the third W head 18 of the fourth row is not conducted, and the jetting of the ink from the fourth W head 21 of the fourth row is conducted. In this case, initially, each process color ink is jetted from each of process color heads of LY head 11–K head 20, and after that, the CPU 9*e* converts the white color data W of the serial data into the white color data W2*b* of the parallel data, and the white color ink is jetted by the fourth W head 21. Thereby, the bottom face printing of the single direction printing (the background color is white) can be conducted.

(iii) The Top Face Printing of the Two-way Printing (the Background Color is White)

(B1) Initially, when the recording medium R is stopped, the carriage 3 which stands by at the initial position, moves along the outward direction B1. Herein, in an arbitrary area to be printed, on the arbitrary area, the first row head 2, 2, . . . passes in the order of the first W head 10, LY head 11, Y head 12 and the second W head 13, and the ink is jetted from the first W head 10, LY head 11 and Y head 12 (in this connection, the ink is not jetted from the second W head 13). At this time, inside the controller 9, the CPU 9*e* controls so that the white color data W of the serial data is converted into the white color data W1*a* of the parallel data.

(B2) Then, the carriage 3 moved along the outward direction B1 arrives at the final position in the outward direction B1.

(B3) After that, the recording medium R moves along the transport direction A by a predetermined amount, and stops.

(B4) After that, the carriage 3 arrived at the final position in the outward direction B1 (the initial position in the homeward direction B2) moves along the homeward direction B2. Herein, on the arbitrary area shown in (B1), the first row head 2, 2, . . . passes in the order of the second W head 13, Y head 12, LY head 11, and the first W head 10, and the ink is jetted from the second W head 13, Y head 12, and LY head 11, (in this connection, the ink is not jetted from the first W head 10). At this time, inside the controller 9, the CPU 9*e* controls so that the white color data W of the serial data is converted into the white color data W1*b* of the parallel data.

(B5) Then, the carriage 3 moved along the homeward direction B2 arrives at the final position in the homeward direction B2 (the initial position in the outward direction B1).

(B6) After that, the recording medium R moves along the transport direction A by a predetermined amount, and stops.

(B7) Then, a series of movements shown in (B1) to (B6) are repeated by adequate times.

(B8) Further, also after that, on the arbitrary area shown in (B1), the second–the fourth row heads 14–21 pass, and a series of movement composed of a predetermined amount of the movement and the stoppage of the recording medium R, and the reciprocal movement toward the outward direction B1 and the homeward direction B2 of the carriage 3, is repeated by adequate times so that the ink is jetted from these heads 14–21. Herein, when, on the arbitrary area shown in (B1), the fourth row heads 18–21 pass, the ink is jetted from the K head and LK head 19, however, the ink is not jetted from the third W head 18 and fourth W head 21.

(B9) The movement of the above-described (B1)–(B8) is conducted, and the printing onto the arbitrary area shown in (B1) is completed.

Then, when the movement as described above is conducted on the recording medium R, the top face printing of the two-way printing (the background color is white) can be conducted. That is, when the carriage 3 moves along the outward direction B1, the CPU 9*e* converts the white color data W of the serial data into the white color data W1*a* of the parallel data, and the white color ink is initially jetted by the first W head 10, and after that, each process color ink is jetted by each of process color heads of the LY head 11–K head 20. Further, when the carriage 3 moves along the homeward direction B2, the white color data W of the serial data is converted into the white color data W1*b* of the parallel data, and white color ink is initially jetted by the second W head 13, and after that, each process color ink is jetted by each of process color heads of the LY head 11–K head 20.

(iv) The Bottom Face Printing of the Two-way Printing (the Background Color is White)

It is almost the same as the case of the top face printing of the above-described (iii) the two-way printing. The different point is that the jetting of the ink from the first W head 10 and the second W head 13 of the first row, is not conducted, and the jetting of the ink from the third W head 18 and the fourth W head 21 of the fourth row is conducted. In this case, when the carriage 3 moves along the outward direction B1, initially, each process color ink is jetted by each of process color heads of LY head 11–K head 20, and after that, the CPU 9*e* converts the white color data W of the serial data into the white color data W2*b* of the parallel data, and the white color ink is jetted by the fourth W head 21. Further, when the carriage 3 moves along the homeward direction B2, initially, each process color ink is jetted by each of process color heads of LY head 11–K head 20, after that, the CPU 9*e* converts the white color data W of the serial data into the white color data W2*a* of the parallel data, and the white color ink is jetted by the third W head 18. Thereby, the bottom face printing of the two-way printing (the background color is white) can be conducted.

As described above, in the first mode, in the carriage 3, the first W head 10, second W head 13, third W head 18 and fourth W head 21 are arranged at the position of 4 portions which are separated from each other, and each of process color heads of LY head 11–K head 20 is arranged between these first–fourth W heads 10, 13, 18, and 21. Then, in the single direction printing and two-way printing, when the carriage 3 moves along the outward direction B1, the jetting of the ink from the first W head 10 of the first row and the fourth W head 21 of the fourth row is considered. On the one hand, in the two-way printing, when the carriage 3 moves along the homeward direction B2, the jetting of the ink from the second W head 13 of the first row and the third W head 18 of the fourth row, is considered. In this case, it is understood that the W heads are arranged at two portions (the position of the first W head 10 and the fourth W head 21, or the position of the second W head 13 and the third W head 18) whose interval is spaced along the transport direction of the carriage 3 (the outward direction B1 and homeward direction B2).

Simultaneously, in the top face printing, in the top face printing, when the carriage 3 moves along the outward direction B1, the CPU 9*e* converts the white color data W of the serial data into the white color data W1*a* of the parallel data, on the one hand, in the top face printing, when the carriage 3 moves along the homeward direction B2, the CPU 9*e* converts the white color data W of the serial data into the white color data W1*b* of the parallel data, thereby, after the white color ink is jetted, each process color ink is jetted. Further, in the bottom face printing, when the carriage 3 moves along the outward direction B1, the CPU 9*e* converts the white color data W of the serial data into the white color data W2*a* of the parallel data, thereby, after the white color ink is jetted, each process color ink is jetted. That is, the CPU 9*e* has the function as the control means for selectively controlling whether the top face printing is conducted by jetting each process color ink after the white color ink is jetted, or whether the bottom face printing is conducted by jetting the white color ink after each process color ink is jetted.

When such a structure is adopted, in the printing whose background color is white, for example, the bottom face printing can selectively be conducted for the transparent recording medium, on the one hand, the top face printing can selectively be conducted as usual for the opaque recording medium R. Thereby, the printer 1 can conduct the printing onto various kind of recording media correspondingly on a case-by-case basis, further, also for the transparent or opaque resin packing material, it can conduct the printing correspondingly on a case-by-case basis. Further, the above-described effect of advantages can be attained by a simple structure in which, on the single carriage 3, the first–fourth white heads 10, 13, 18, 21, and each of process color heads 11, 12, 14, 15, 16, 17, 19, and 20 are mounted, and the arrangement of these heads 10–21 is considered.

In this connection, in the case where the top face printing is conducted, when the density of the white color ink of the first W head 10 and the second W head 13 by which the ink is jetted before each of process color heads 11, 12, 14, 15, 16, 17, 17, 19, and 20, is small, the following is made so that the W heads 22, 23, 24, and 25 (heads shown by dotted line in FIG. 3) are further provided at the first row and/or the third row, and the white color ink is also jetted from at least one W head of these W heads 22, 23, 24, 25 and the third head W head 18 and the fourth W head 21 of the fourth row, and on the white color ink jetted from the first W head 10 and the second W head 13, the white color ink is further overlapped, and the white color printing area may be formed.

Further, the structure is made in such a manner that, from (1) between the first W head 10 and LY head 11 of the first row, (2) between the second W head and Y head of the first row, (3) between the third W head 18 and LK head 19 of the fourth row, and (4) between the fourth W head 21 and K head 20, toward the recording medium, the ultraviolet ray from the UV light source can be irradiated, and it may also be allowable that, after the white color ink is jetted from the first–fourth W heads 10, 13, 18, 21, the white color ink which is the UV ink, is hardened or semi-hardened at soon, and the color mixture with the white color ink is prevented.

[The Second Mode]

Figure 5:
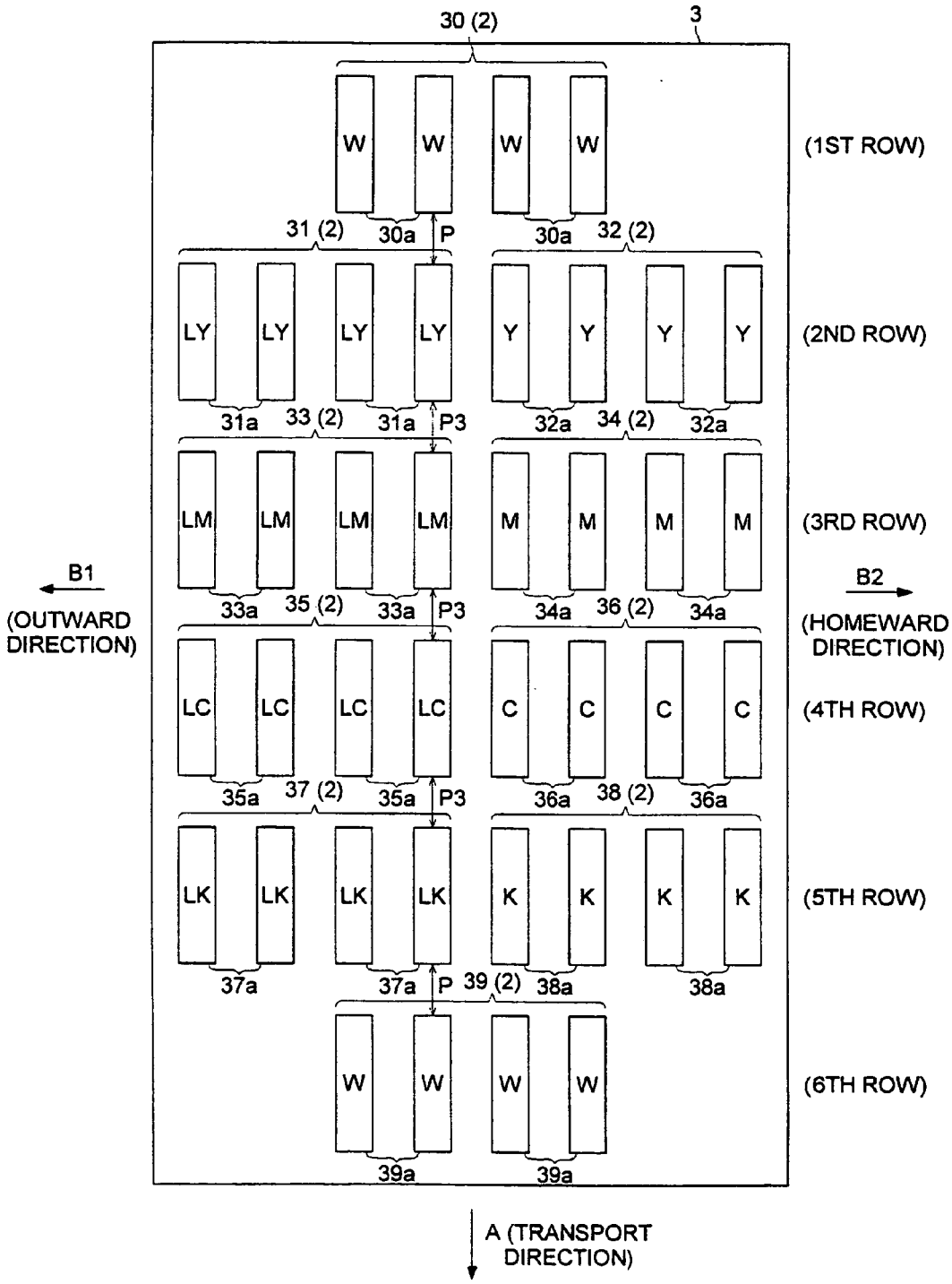
FIG. 5 is a view showing the arrangement relationship of the white color head and each of the process color heads according to the second mode of the present embodiment.

As shown in FIG. 5, a plurality of heads 2, 2, . . . are mounted in the carriage 3. These plurality of heads 2, 2, . . . , are structured by the first and second white color heads to jet the white ink 30 and 39, and respective process color heads to jet respective process color inks 31–38. Then, these plural heads 30–39 are arranged over 6 rows (the first row–sixth row). The specific arrangement of respective row heads 30–39 is as follows, from the left side in FIG. 3, (1) the first row: the first W head 30, (2) the second row: LY head 31, Y head 32, (3) the third row: LM head 33, M head 34, (4) the fourth row: LC head 35, C head 36, (5) the fifth row: LK head 37, K head 38, (6) the sixth row: the second W head 39.

In this connection, each of heads 30–39 is respectively provided with a plurality of nozzles (not shown), and is divided into 4 divided heads for respective nozzles of a predetermined number (for example, 128 nozzles). For example, when it is described referring to the first W head 30, the first W head 30 is structured by 4 W-divided heads 30*a*, 30*a*, . . . ,. As for respective heads 31–39 except for the first W head 30, it is also the same. Further, each of heads 30, 39, in each row of the first and the sixth row, are arranged at almost central position corresponding to the 4 divided heads arranged in the center of respective LY–K heads 31–38 of the second–fourth row.

Figure 6:
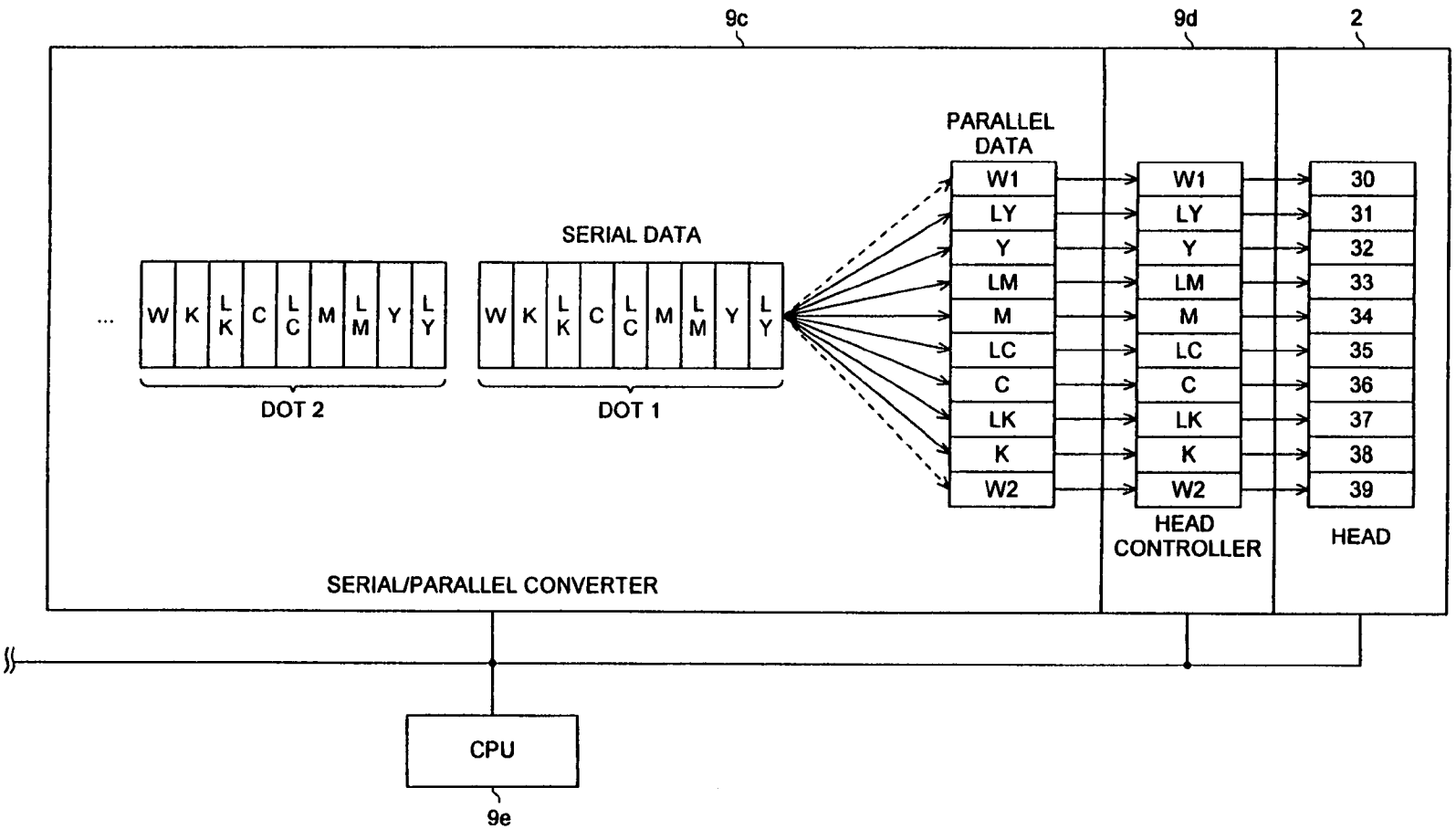
FIG. 6 is a view for explaining the movement of the inside of the control device according to the second mode.

Further, inside the controller 9, as shown in FIG. 6, the image data inputted into the conversion section 9*c* is the serial data for each dot in which each color of the white color and each process color is made one set, and in this conversion section 9*c*, it is converted from the serial data into the parallel data. Specifically, each color data (W, K–LY) for each dot of the serial data is converted into parallel data (W1–W2) corresponding to each color of heads 30–29. Then, the data of each color converted into the parallel data is outputted to the head control section 9*d*, and the head control section 9*d* respectively outputs the drive signal corresponding to each color data to the line connected to each color of heads 30–39, and drives each color of heads 30–39. Then, the ink is jetted from each color of heads 30–29. That is, the each color data of the serial data is converted into the parallel data corresponding to each color of heads 30–29, thereby, it is distributed as the data for each color, and the data distributed into each color is converted into the drive signal and respectively outputted to each color of heads 30–29. In this connection, in more detail, each color data corresponding to the position of each dot is further converted into the drive signal for each nozzle in each color of heads 30–29.

Herein, because the number of the heads for the white color (the first–the second W head 30, 39) is 2, relating to the white color data W in the serial data, when it is converted into the parallel data in the conversion section 9*c*, it is distributed to any one of 2 white color data W1–W2 corresponding to 2 heads of the first and second W head 30, 39 for the white color.

In the case of the top face printing in which the background color is white, the white color data W in the serial data is distributed into the white color data W1 of the parallel data. Further, in the case of the bottom face printing in which the background color is white, the white color data W in the serial data is distributed into the white color data W2 of the parallel data. In this connection, the above-described conversion is conducted by the control of the CPU 9*e* according to the inputted control signal.

Next, the printing movement of the printer 1 when each kind of printing shown in the following (i)–(iv) in the arrangement relationship of the plurality of heads 2, 2, . . . , is conducted, will be described. In this connection, in the same as in the first mode, the recording medium R on which the printing is conducted, is transported along the transport direction A, however, in this case, it is intermittently transported in a predetermined transport amount determined corresponding to the resolution of the image. That is, the recording medium R is transported while repeating the movement of the predetermined amount in the transport direction and the stoppage.

(i) The Top Face Printing of the Single Direction Printing (the Background Color is White)

(C1) Initially, when the recording medium R is stopped, the carriage 3 standing by at the initial position, moves along the outward direction B1. Herein, in an arbitrary area to be printed, on the arbitrary area, the first W head 30 of the first row passes and the ink is jetted from the first W head 30. At this time, inside the controller 9, the CPU 9*e* controls so that the white color data W of the serial data is converted into the white color data W1 of the parallel data.

(C2) Then, the carriage 3 moved along the outward direction B1 arrives at the final position in the outward direction B1 and returns to the initial position. In this case, the recording medium R is in the condition that it is stopped.

(C3) After that, the recording medium R moves along the transport direction by a predetermined amount, and stops.

(C4) Then, a series of movements shown in (C1) to (C3) are repeated by adequate times.

(C5) Also after that, on the arbitrary area shown in (C1), heads 31–39 of the second row–the sixth row pass, and a series of movements composed of a predetermined amount of the movement and stoppage of the recording medium R, and the reciprocal movement toward the outgoing direction B1 and the homeward direction B2 of the carriage 3, are repeated by the adequate times so that the ink is jetted from these heads 31–39.

Herein, when the second W head 39 of the sixth row passes on the arbitrary area shown in (C1), the ink is not jetted from the second W head 39.

(C6) Above-described movements of (C1)–(C5) are conducted, and the printing onto the arbitrary area shown in (C1) is completed.

When the movement as described above is conducted on the recording medium R, the top face printing (the background color is white) of the single direction printing can be conducted. In this case, the CPU 9*e* converts the white color data W of the serial data into the white color data W1 of the parallel data, and the white color ink is initially jetted by the first W head 30 of the first row, and after that, each process color ink is jetted by each of process color heads of LY head 31–K head 38.

(ii) The Bottom Face Printing of the Single Direction Printing (the Background Color is White)

It is almost the same as the case of the top face printing of the above-described (i) the single direction printing. The different point is that the jetting of the ink from the first W head 30 of the first row is not conducted, and the jetting of the ink from the second W head 39 of the sixth row is conducted. In this case, initially, each process color ink is jetted from each of process color heads of LY head 31–K head 38, and after that, the CPU 9*e* converts the white color data W of the serial data into the white color data W2 of the parallel data, and the white color ink is jetted by the sixth W head 39. Thereby, the bottom face printing of the single direction printing (the background color is white) can be conducted.

(iii) The Top Face Printing of the Two-way Printing (the Background Color is White)

(D1) Initially, when the recording medium R is stopped, the carriage 3 which stands by at the initial position, moves along the outward direction B1. Herein, in an arbitrary area to be printed, on the arbitrary area, the first W head 30 of the first row passes, and the ink is jetted from the first W head 30. At this time, inside the controller 9, the CPU 9*e* controls so that the white color data W of the serial data is converted into the white color data W1 of the parallel data.

(D2) Then, the carriage 3 moved along the outward direction B1 arrives at the final position in the outward direction B1.

(D3) After that, the recording medium R moves along the transport direction A by a predetermined amount, and stops.

(D4) After that, the carriage 3 arrived at the final position in the outward direction B1 (the initial position in the homeward direction B2) moves along the homeward direction B2. Also in this case, in the same manner as in (D1), on the arbitrary area shown in (D1), the first W head 30 of the first row passes, and the ink is jetted from the first W head 30. At this time, also inside the controller 9, the CPU 9*e* controls so that the white color data W of the serial data is converted into the white color data W1 of the parallel data.

(D5) Then, the carriage 3 moved along the homeward direction B2 arrives at the final position in the homeward direction B2 (the initial position in the outward direction B1).

(D6) After that, the recording medium R moves along the transport direction A by a predetermined amount, and stops.

(D7) Then, a series of movements shown in (D1) to (D6) are repeated by adequate times.

(D8) Further, also after that, on the arbitrary area shown in (D1), the second–the sixth row heads 31–39 pass, and a series of movement composed of a predetermined amount of the movement and the stoppage of the recording medium R, and the reciprocal movement toward the outward direction B1 and the homeward direction B2 of the carriage 3, is repeated by adequate times so that the ink is jetted from these heads 31–39. Herein, when, on the arbitrary area shown in (D1), the second W head 39 of the sixth row passes, the ink is not jetted from the second W head 39.

(B9) The movement of the above-described (D1)–(D8) is conducted, and the printing onto the arbitrary area shown in (D1) is completed.

When the movement as described above is conducted on the recording medium R, the top face printing of the two-way printing (the background color is white) can be conducted. In this case, the CPU 9*e* converts the white color data W of the serial data into the white color data W1 of the parallel data, and the white color ink is initially jetted by the first W head 30 of the first row, and after that, each process color ink is jetted by each of process color heads of the LY head 31–K head 38.

(iv) The Bottom Face Printing of the Two-way Printing (the Background Color is White)

It is almost the same as the case of the top face printing of the above-described (iii) the two-way printing. The different point is that the jetting of the ink from the first W head 30 of the first row is not conducted, but the jetting of the ink from the second W head 39 of the sixth row is conducted. In this case, initially, each process color ink is jetted by each of process color heads of LY head 31–K head 38, and after that, the CPU 9*e* converts the white color data W of the serial data into the white color data W2 of the parallel data, and the white color ink is jetted by the sixth W head 39. Thereby, the bottom face printing of the two-way printing (the background color is white) can be conducted.

As described above, in the second mode, in the carriage 3, the first W head 30 and second W head 39 are arranged at the position of 2 portions which are separated from each other, and LY head 31–K head 38 are arranged between these W heads. Then, in also any printing in the single direction printing and two-way printing, the jetting of the ink from the first W head 30 of the first row and the second W head 39 of the sixth row is considered. In this case, it can be understood that the W heads are arranged at two portions (the positions of the first W head 30 and the second W head 39) whose interval is spaced along the direction (the transport direction A of the recording medium R) crossing (almost perpendicular to) the transport direction of the carriage 3 (the outward direction B1 and homeward direction B2).

Simultaneously, in the top face printing, in spite of the movement direction of the carriage 3, the CPU 9*e* converts the white color data W of the serial data into the white color data W1 of the parallel data, thereby, after the white color ink is jetted, each process color ink is jetted. Further, in the bottom face printing, in spite of the movement direction of the carriage 3, the CPU 9*e* converts the white color data W of the serial data into the white color data W2 of the parallel data, thereby, the white color ink is jetted after each process color ink is jetted. That is, the CPU 9*e* has the function as the control means for selectively controlling whether the top face printing is conducted by jetting each process color ink after the white color ink is jetted, or whether the bottom face printing is conducted by jetting the white color ink after each process color ink is jetted.

When such a structure is adopted, in the printing whose background color is white, for example, the bottom face printing can selectively be conducted for the transparent recording medium, on the one hand, the top face printing can selectively be conducted as usual for the opaque recording medium R. Thereby, the printer 1 can conduct the printing onto various kind of recording media correspondingly on a case-by-case basis, and also for the transparent or opaque resin packing material, it can conduct the printing correspondingly on a case-by-case basis. Further, the above-described effect of advantages can be attained by a simple structure in which, on the single carriage 3, the first and second white color heads 30, 39 and each of process color heads 31–38 are mounted, and the arrangement of these heads 30–39 is considered.

Further, the structure is made in such a manner that, from (1) between the first W head 10 of the first row and LY head 31 and Y head 32 of the second row, and (2) between the second W head 39 of the sixth row and LK head 37 and K head 38 of the fifth row toward the recording medium R, the ultraviolet ray from the UV light source can be irradiated, and it may also be preferable that, after the white color ink is jetted from the first and second W heads 30 and 39, the white color ink which is the UV ink, is hardened or semi-hardened at soon, and the color mixture with the white color ink is prevented.

[The Third Mode]

Figure 7:
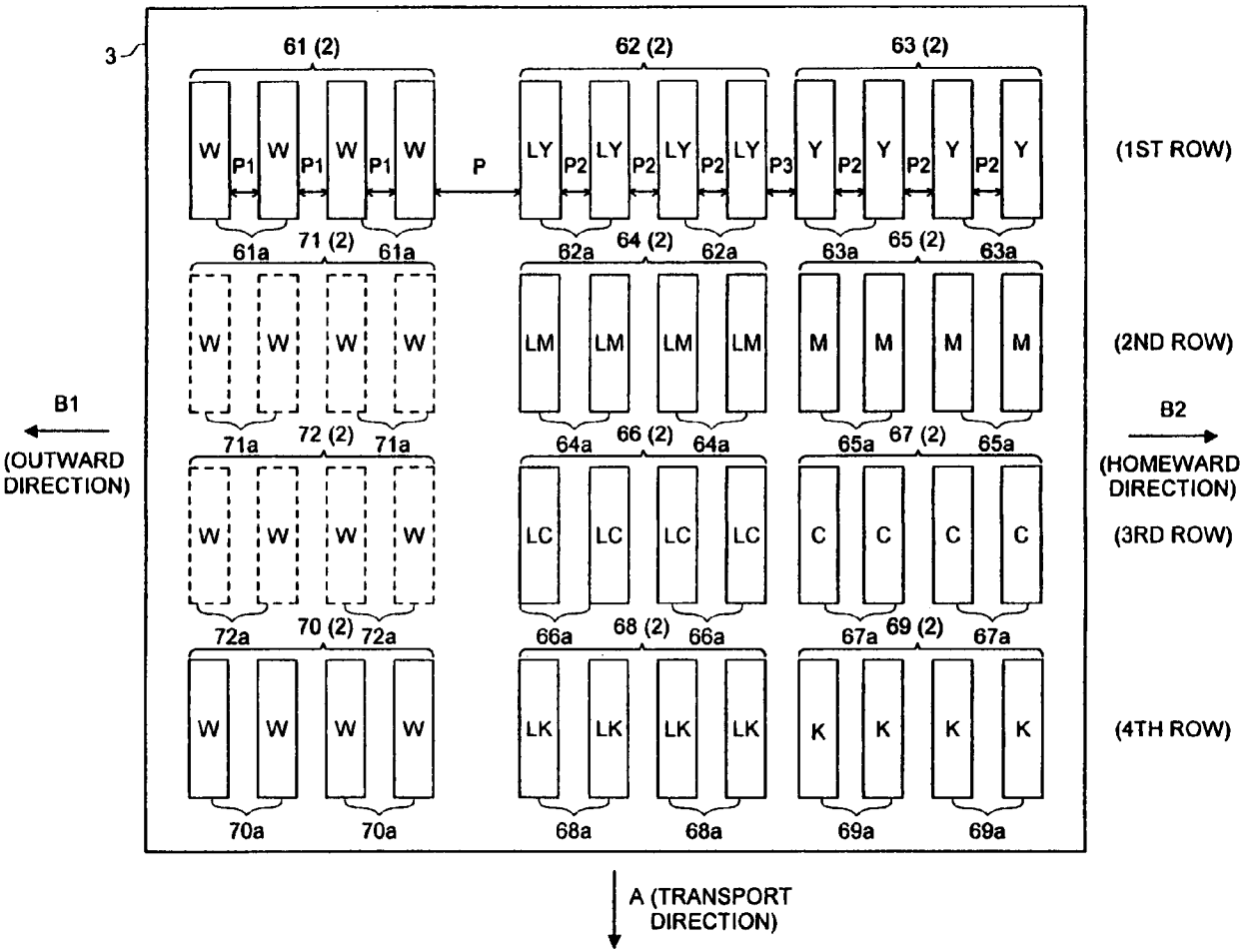
FIG. 7 is a view showing the arrangement relationship of the white color head and each of the process color heads according to the third mode of the present embodiment.

As shown in FIG. 7, a plurality of heads 2, 2, . . . are mounted in the carriage 3. These plurality of heads 2, 2, . . . , are structured by the first and second white color heads to jet the white ink 61 and 70, and respective process color heads to jet respective process color inks 62–69. Then, the plurality of heads 61–70 are arranged over 4 rows (the first row–fourth row). The specific arrangement of respective row heads 61–70 is as follows, from the left side in FIG. 7, (1) the first row: the first W head 61, LY head 62, Y head 63, (2) the second row: LM head 64, M head 65, (3) the third row: LC head 66, C head 67, (4) the fourth row: the second W head 70, LK head 68, and K head 69.

In this connection, each of heads 61–70 is respectively provided with a plurality of nozzles (not shown), and is divided into 4 divided heads for respective nozzles of a predetermined number (for example, 128 nozzles). For example, when it is described referring to the first W head 61, the first W head 61 is structured by 4 W-divided heads 61*a*, 61*a*, . . . ,. As for respective heads 62–70 except for the first W head 61, it is also the same.

Further, inside the controller 9, as shown in FIG. 8, the image data inputted into the conversion section 9*c* is the serial data for each dot in which each color of the white color and each process color is made one set, and in this conversion section 9*c*, it is converted from the serial data into the parallel data. Specifically, each color data (W, K–LY) for each dot of the serial data is converted into parallel data (W1–W2) corresponding to each color of heads 61–70. Then, the data of each color converted into the parallel data is outputted to the head control section 9*d*, and the head control section 9*d* respectively outputs the drive signal corresponding to each color data to the line connected to each color of heads 61–70, and drives each color of heads 61–70. Then, the ink is jetted from each color of heads 61–70. That is, the each color data of the serial data is converted into the parallel data corresponding to each color of heads 61–70, thereby, it is distributed as the data for each color, and the data distributed into each color is converted into the drive signal and respectively outputted to each color of heads 61–70. In this connection, in more detail, each color data corresponding to the position of each dot is further converted into the drive signal for each nozzle in each color of heads 61–70.

Herein, because the number of the heads for the white color (the first and the second W head 61, 70) is 2, relating to the white color data W in the serial data, when it is converted into the parallel data in the conversion section 9*c*, it is distributed to any one of 2 white color data W1–W2 corresponding to 2 heads of the first and second W head 61, 70 for the white color.

In the case of the top face printing in which the background color is white, the white color data W in the serial data is distributed into the white color data W1 of the parallel data. Further, in the case of the bottom face printing in which the background color is white, the white color data W in the serial data is distributed into the white color data W2 of the parallel data. In this connection, the above-described conversion is conducted by the control of the CPU 9*e* according to the inputted control signal.

Next, the printing movement of the printer 1 when each kind of printing shown in the following (i) and (ii) in the arrangement relationship of the plurality of heads 2, 2, . . . , is conducted, will be described. Hereupon, in the same manner as in the first mode and the second mode, the recording medium R on which the printing is conducted, is transported along the transport direction A, however, in this case, it is transported in a predetermined transport amount determined corresponding to the resolution of the image, and intermittently. That is, the recording medium R is transported while repeating the movement of the predetermined amount in the transport direction and the stoppage.

(i) The Top Face Printing of the Single Direction Printing (the Background Color is White)

(E1) Initially, when the recording medium R is stopped, the carriage 3 standing by at the initial position, moves along the outward direction B1. Herein, in an arbitrary area to be printed, on the arbitrary area, the first row heads 2, 2, . . . pass in the order of the first W head 61, LY head 62, and Y head 63, and the ink is jetted from the first W head 61, LY head 62 and Y head 63. At this time, inside the controller 9, the CPU 9*e* controls so that the white color data W of the serial data is converted into the white color data W1 of the parallel data.

(E2) Then, the carriage 3 moved along the outward direction B1 arrives at the final position in the outward direction B1 and returns to the initial position. In this case, the recording medium R is in the condition that it is stopped.

(E3) After that, the recording medium R moves along the transport direction A by a predetermined amount, and stops.

(E4) Then, a series of movements shown in (E1) to (E3) are repeated by adequate times.

(E5) Also after that, on the arbitrary area shown in (E1), the second row–fourth row heads 64–70 pass, and a series of movement composed of a predetermined amount of the movement and the stoppage of the recording medium R, and the reciprocal movement toward the outward direction B1 and the homeward direction B2 of the carriage 3, is repeated by adequate times so that the ink is jetted from these heads 64–70. Herein, when the second W head 70 of the fourth row passes on the arbitrary area shown in (E1), the ink is not jetted from the second W head 70.

(E6) The movement of the above-described (E1)–(E5) is conducted, and the printing onto the arbitrary area shown in (E1) is completed.

When the movement as described above is conducted onto the recording medium R, the top face printing of the single direction printing (the background color is white) can be conducted. In this case, the CPU 9*e* converts the white color data W of the serial data into the white color data W1 of the parallel data, and the white color ink is initially jetted by the first W head 61 of the first row, and after that, each process color ink is jetted by each of process color heads of the LY head 62–K head 69.

(ii) The Bottom Face Printing of the Single Direction Printing (the Background Color is White)

(F1) Initially, when the recording medium R is stopped, the carriage 3 standing by at the initial position (final position in the outward direction B1), moves along the homeward direction B2. Herein, in an arbitrary area to be printed, on the arbitrary area, the first row heads 2, 2, 2, . . . pass in the order of the Y head 63, LY head 62 and the first W head 61, and the ink is jetted from the Y head 63 and LY head 62. (Hereupon, the ink is not jetted from the first W head 61).

(F2) After that, the carriage 3 moved along the homeward direction B2 arrives at the final position in the homeward direction B2 and returns to the initial position (final position in the outward direction B1). In this case, the recording medium R is in the condition that it is stopped.

(F3) After that, the recording medium R moves along the transport direction A by a predetermined amount, and stops.

(F4) Then, a series of movements shown in (F1) to (F3) are repeated by adequate times.

(F5) Also after that, on the arbitrary area shown in (F1), the second row–fourth row heads 64–70 pass, and a series of movements composed of a predetermined amount of the movement and the stoppage of the recording medium R, and the reciprocal movement toward the outward direction B1 and the homeward direction B2 of the carriage 3, are repeated by adequate times so that the ink is jetted from these heads 64–70. Herein, when the second W head 70 of the fourth row passes on the arbitrary area shown in (F1), the CPU 9*e* converts the white color data W of the serial data into the white color data W2 of the parallel data, and the white color ink is jetted by the second W head 70.

(F6) The movement of the above-described (F1)–(F5) is conducted, and the printing onto the arbitrary area shown in (F1) is completed.

When the movement as described above is conducted on the recording medium R, the bottom face printing of the single direction printing (the background color is white) can be conducted. In this case, initially, each process color ink is jetted by each of process color heads of LY head 62–K head 69, and after that, the CPU 9*e* converts the white color data W of the serial data into the white color data W2 of the parallel data, and the white color ink is jetted by the second W head 70.

As described above, in the third mode, in the carriage 3, the first W head 61 and second W head 70 are arranged at the position of 2 portions which are separated from each other, and respective process color heads of LY head 62–K head 69 are arranged over the four rows on the adjoining side of these first W head 61 and second W head 70. Then, a case where the jetting of the ink from respective heads 2, 2, . . . can be conducted, is considered as the case where, corresponding to the case where the carriage 3 moves along the outward direction B1, or it moves along the homeward direction, the ink is jetted from the first W head 61 of the first row and the second W head 70 of the fourth row. In this case, it can be understood that the W head is arranged at one portion along the movement direction (the outward direction B1 or the homeward direction B2) of the carriage 3 to respective process color heads of the LY head 62–K head 69.

Simultaneously, in the top face printing, the CPU 9*e* converts the white color data W of the serial data into the white color data W1 of the parallel data, thereby, after the white color ink is jetted, each process color ink is jetted. Further, in the bottom face printing, the CPU 9*e* converts the white color data W of the serial data into the white color data W2 of the parallel data, thereby, the white color ink is jetted after each process color ink is jetted. That is, the CPU 9*e* has the function as the control means for selectively controlling whether the top face printing is conducted by jetting each process color ink after the white color ink is jetted, or whether the bottom face printing is conducted by jetting the white color ink after each process color ink is jetted.

When such a structure is adopted, in the printing whose background color is white, for example, the bottom face printing can selectively be conducted for the transparent recording medium, on the one hand, the top face printing can selectively be conducted as usual for the opaque recording medium R. Thereby, the printer 1 can conduct the printing onto various kind of recording media correspondingly on a case-by-case basis, and also for the transparent or opaque resin packing material, it can conduct the printing correspondingly on a case-by-case basis. Further, the above-described effect of advantages can be attained by a simple structure in which, on the single carriage 3, the first and second white color heads 61, 70 and each of process color heads 62–69 are mounted, and the arrangement of these heads 61–70 is considered.

Hereupon, in the case where the top face printing is conducted, when the density of the white color ink of the first W head 10 and the second W head 13 by which the ink is jetted before each of process color heads 11, 12, 14, 15, 16, 17, 17, 19, and 20, is small, the following is made so that the W heads 22, 23, 24, and 25 (heads shown by dotted line in FIG. 3) are further provided at the first row and/or the third row, and the white color ink is also jetted from at least one W head of these W heads 22, 23, 24, 25 and the third head W head 18 and the fourth W head 21 of the fourth row, and on the white color ink jetted from the first W head 10 and the second W head 13, the white color ink is further overlapped, and the white color printing area may be formed.

Further, the structure is made in such a manner that, from (1) between the first W head 61 and LY head 62 of the first row, (2) between the second W head 70 and LK head 68 of the fourth row, toward the recording medium, the ultraviolet ray from the UV light source can be irradiated, and it may also be allowable that, after the white color ink is jetted from the first and second W heads 61, 70, the white color ink which is the UV ink, is hardened or semi-hardened at soon, and the color mixture with the white color ink is prevented.

Further, during the printing movement of the printer 1, the carriage 3 reciprocally moves along the outward direction B1 and the homeward direction B2, however, relating to the carriage 3 according to the present third mode, when the carriage 3 turns back from the outward direction B1 to the homeward direction B2, and from the homeward direction B2 to the outward direction B1, it may also be structured so that the carriage 3 itself is rotated by 180°.

Figure 9:
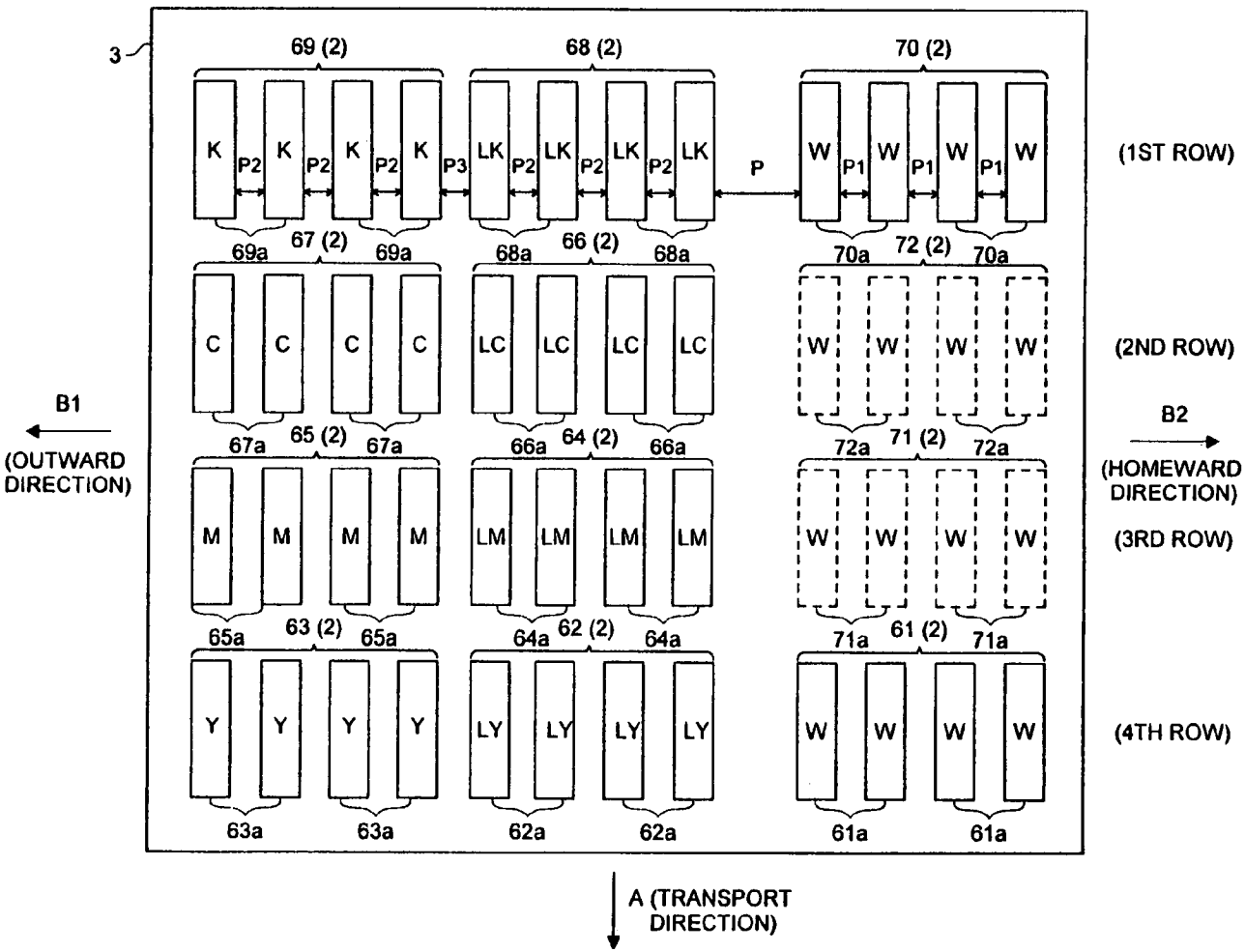
FIG. 9 is a view showing the arrangement relationship of each head when a carriage is rotated by 180°, according to the third mode.

When the printing movement of the printer provided with this structure is briefly described, in the case where the movement of only the carriage 3 is remarked, when the carriage 3 moves along the outward direction B1, the carriage 3 moves under the condition that the arrangement of each head 2 shown in FIG. 7 is kept. Then, when the carriage 3 turns the movement direction from the outward direction B1 to the homeward direction B2, the carriage 3 is rotated by 180°. The arrangement of each head 2 in the carriage 3 when it is rotated, is shown in FIG. 9. After that, the carriage 3 moves along the homeward direction B2 under the condition that the arrangement of each head 2 shown in FIG. 9 is kept, and when the movement direction is changed from the homeward direction B2 to the outward direction B, it is rotated by 180°. Then, the carriage 3 repeats the above-described movement.

Further, when the jetting of the ink of each head 2 is remarked, (i) in the top face printing (the background color is white), when the carriage 3 moves along the outward direction B1, in the arbitrary area of the recording medium R to be printed, initially, the white color ink is jetted from the first W head 61, after that, each process color ink is jetted from each of process color heads 62–69. In this case, inside the controller 9, the CPU 9*e* controls so that the white color data W of the serial data is converted into the white color data W1 of the parallel data.

When the carriage 3 moves along the homeward direction B2, in the arbitrary area of the recording medium R to be printed, initially, the white color ink is jetted from the second W head 70, after that, each process color ink is jetted from each of process color heads 62–69. In this case, inside the controller 9, the CPU 9*e* controls so that the white color data W of the serial data is converted into the white color data W2 of the parallel data. When the movement as described above is conducted on the recording medium R, the top face printing (the background color is white) of the two-way printing becomes possible.

(ii) In the bottom face printing (the background color is white), when the carriage 3 moves along the homeward direction B2, in the arbitrary area of the recording medium R to be printed, initially, each process color ink is jetted from each of process color heads 62–69, after that, the white color ink is jetted from the second W head 70. In this case, inside the controller 9, the CPU 9*e* controls so that the white color data W of the serial data is converted into the white color data W2 of the parallel data. When the movement as described above is conducted on the recording medium R, the top face printing (the background color is white) of the two-way printing becomes possible. When the carriage 3 moves along the outward direction B1, in the arbitrary area of the recording medium R to be printed, initially, each process color ink is jetted from each of process color heads 62–69, after that, the white color ink is jetted from the first W head 61. In this case, inside the controller 9, the CPU 9*e* controls so that the white color data W of the serial data is converted into the white color data W1 of the parallel data. When the movement as described above is conducted on the recording medium R, the bottom face printing (the background color is white) of the two-way printing becomes possible.

Hereupon, in the present embodiment including the above-described first mode, second mode and third mode, although each color of ink is jetted from each of process color heads 2, it is not always necessary that the ink is jetted from all of process color heads 2, but it may also be allowable that the ink is jetted from at least one process color head 2 in each of process color heads 2. In addition, although the number of divided heads constituting each head 2 are shown as respectively 4, in FIG. 3, FIG. 5 and FIG. 7, but it is not always necessary that the number of divided heads of each head 2 is 4, and the number of divided heads of each head 2 can be adequately changed. Of course, each head 2 may not be structured by the divided heads divided into the plural heads, but may also be structured by a single body.

Further, relating to the arrangement of each head 2 shown in the first mode, second mode, and third mode, as shown in FIG. 3, FIG. 5 and FIG. 7, when the interval between each of W divided heads of each W head 2, is a pitch P1; the interval between each of process color divided heads of each of the process color heads 2, is a pitch P2; the interval between process color heads 2 adjoining each other, is a pitch P3; and the interval between W head 2 and the process color head 2 adjoining the W head 2, is a pitch P, in the case where the W head 2 and the process color head 2 are arranged along the movement direction (outward direction B1 or homeward direction B2) of the carriage 3, as shown in FIG. 3 and FIG. 7, the pitch P, P1, P2, and P3 are almost the same along the movement direction of the carriage 3. Further, when the W head 2 and the process color head 2 are arranged along the transport direction A of the recording medium R, as shown in FIG. 5, the pitch P and P3 are almost the sane along the transport direction A of the recording medium R. Hereupon, in FIG. 3, FIG. 5 and FIG. 7, only the pitch of one portion is shown.

Figure 10:
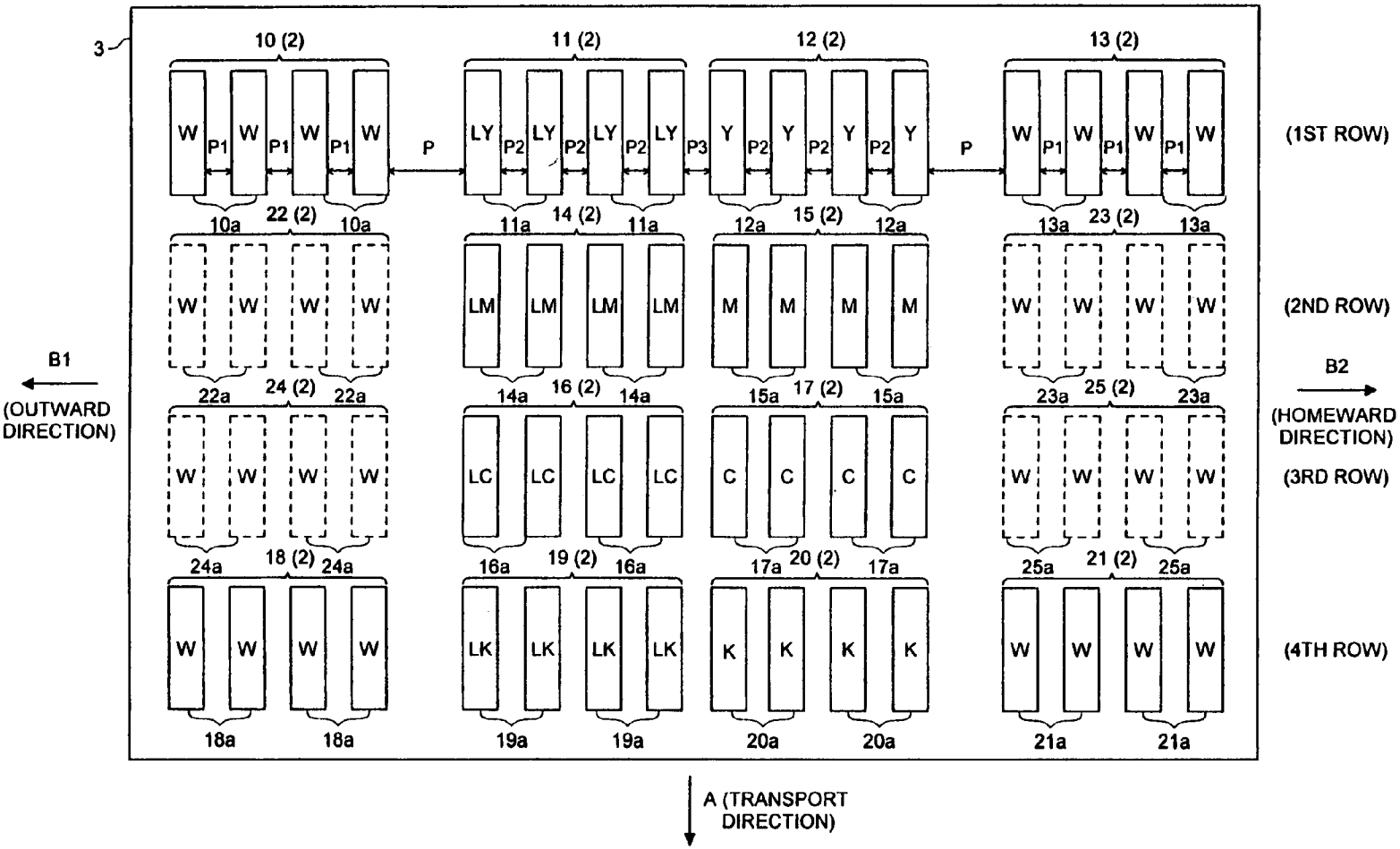
FIG. 10 is a view showing an example in which the interval between respective heads according to the first mode is modified.

Then, from the W head 2 and the process color head 2, the ink whose form is different from each other, can be jetted, and from the W head 2 and the process color head 2, the ink whose heating temperature is different from each other, can also be jetted. In this case, the pitch P may also be made broader than at least one pitch in the pitch P1, P2 and P3. For example, the pitch shown in FIG. 3 may also be made to the pitch shown in FIG. 10. In FIG. 10, because the pitch P1 is narrower than the pitch P, mutual respective W divided heads are made in the dense state, and the size reduction of the W head 2 can be attained (the homogenization of the heating temperature of the process color ink can be intended). Then, in the W head 2 and the process color head 2, because each head 2 is mutually made compact (because, specifically, the homogenization of the heating temperature of the portion influencing the jetting of ink can be intended), the one side head 2 is hardly affected by the influence of the temperature difference from the other side head 2 whose heating temperature of the ink is different. Thereby, the ink can be jetted from each head 2 at the more optimum heating temperature.

Of course, also in the example shown in FIG. 5 and FIG. 7, when the ink whose heating temperature is mutually different is jetted, in the W head 2 and the process color head 2, the pitch P may also be made broader than at least one pitch in the pitches P1, P2, and P3. Also in this case, as described above, the ink can be jetted from each head 2 at the more optimum heating temperature.

Further, in the above-described first mode, second mode and third mode, in the white color head 2 and each of the process color heads 2, although each head 2 jets the ink to be jetted, as the ink drop, the jetting amount per one drop of the ink drop jetted from the white color head 2 may also be made larger than the jetting amount per one drop of the ink drop jetted from each of the process color heads 2.

In this case, because the jetting amount per one drop of the ink drop jetted from the white color head 2 is larger than the jetting amount per one drop of the ink drop jetted from each of the process color heads 2, when only one drop of the ink drop is jetted from each head 2 onto the recording medium, the occupied area in which the ink drop from the white color head 2 occupies on the recording medium, is broader than the occupied area of the ink drop from each of the process color heads 2. Accordingly, when several drops of the ink drop are successively respectively jetted onto the recording medium from the white color head 2 and each of the process color heads 2, because the gap of each of ink drops from the white color head 2 is smaller than the gap of each ink drop from each of the process color heads 2, the non-uniformity of the ink drop of the background color formed by the white color head 2 or the moire can be suppressed.

Further, in the present embodiment, the embodiment in which the carriage 3 on which a plurality of heads 2, 2, . . . , are mounted, is moved toward the direction perpendicularly crossing the transport direction A of the recording medium R, is shown, however, it is not limited to such a mode, over the width direction (the direction perpendicular to the transport direction of the recording medium) of the recording medium, each color ink head including the white color ink is respectively arranged, and a structure in which all of respective color ink heads are mounted on a single carriage (single member) as each color ink head (line head) for so-called one line, may also be adopted. In this case, it is preferable to be arranged and provided so that the white ink heads are provided for 2 lines, and all of process color heads are between each of white ink heads.

Further, in the mode of an inkjet printer in which the white ink head and the process color head are mounted on a single carriage, and by which the reciprocal scanning is conducted, in the same manner as the household use inkjet printer on the market, one ink head for each color is respectively arranged in a row toward the scanning direction of the carriage, and at the time, the white ink head is arranged at any position of the top of the outward direction or the top of the homeward direction, and for example, it may also be controlled in such a manner that, in the case of top face printing, the printing in the outward direction is conducted, and in the case of the bottom face printing, the printing in the homeward direction is conducted, and in such a manner that, corresponding to the top face printing or the bottom face printing in the reciprocal scanning of the carriage, the jetting of the ink to conduct the printing is conducted at the time of the movement of the carriage toward a single direction of the scanning direction.

Of course, as shown in the above-described embodiment, it is more preferable that a plurality of white ink heads are provided, in a point that the high speed printing by the reciprocal printing can be conducted in spite of the top face printing and the bottom face printing.

Furthermore, in the present embodiment, it is described that the background color is white, however, it is not limited to this description. That is, instead of the W head to jet the white color ink, when the head to jet the ink of the color excepting the white color, is arranged in the carriage 3, the color except the white color may also be the background color.

Further, the arrangement of the W head is made the same shown in the present embodiment, the color which is mixed with at least one process color in the white color ink and each process color may also be made the background color.

For example, "white color" shown in the present embodiment may also be read by replacing with "special color" except the "white color" such as transparent, gold, silver, blue, green, red, reddish-brown, ocher, or deep red. That is, instead of W head to jet the white color ink, when the head to jet the special color except the white color is arranged in the carriage 3, the special color may also be made the background color. Hereupon, also in the controller 9, the white color data can be read by replacing as the data of "special color".

Figure 11:
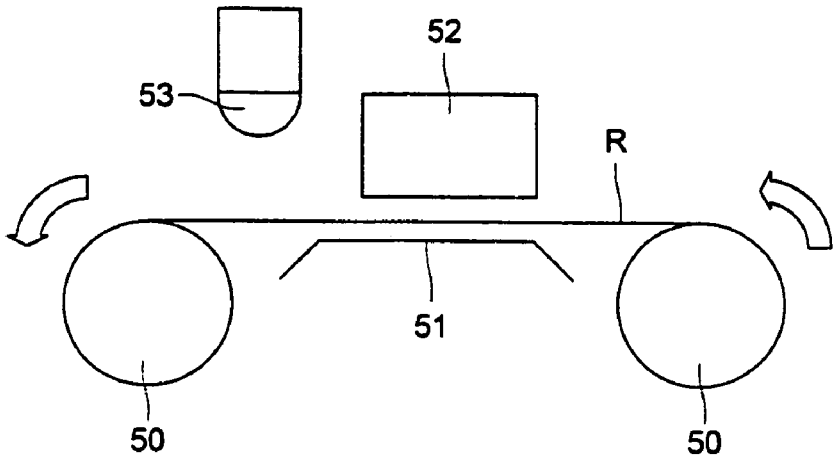
FIGS. 11(*a*) and 11(*b*) are outline structural views showing the modified examples of the inkjet printer.
Figure 11:
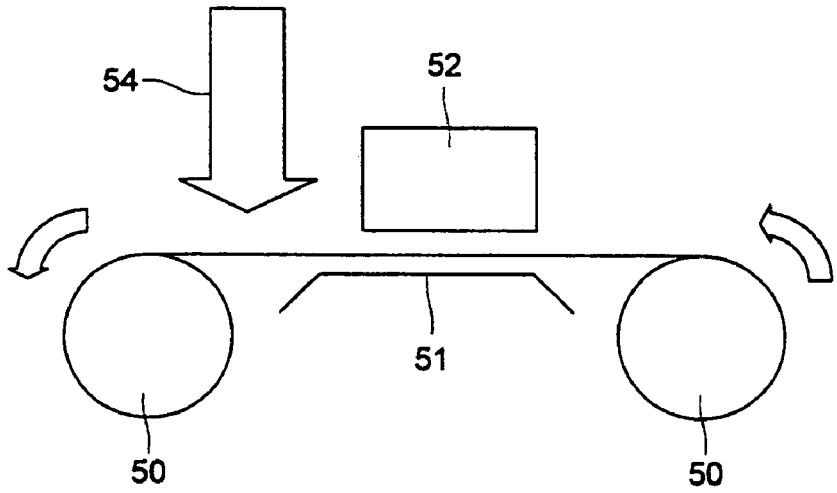

Further, in the present embodiment, it is described that the white color ink and each process color inks are the UV ink, however, the above-described special color ink may also be the UV ink. When these white color ink, each process color ink and the above-described special color ink are the UV ink, as shown in FIG. 11(*a*), the UV light source 53 is provided on the downstream side of the platen 51 in the transport direction of the recording medium, and the ink is jetted by the head 52 under the condition that the ink is sucked and held by the platen 51, and onto the print surface of the recording medium R transported by the transport roller 50, the ultraviolet ray may also be irradiated from the UV light source 53. In this case, the ink jetted onto the recording medium R can be hardened at soon.

Further, the white color ink and each process color inks and the above-described special color ink shown in the present embodiment may also be at least one ink in the aqueous ink, oil-based ink, solvent ink, and solid ink. In this case, as shown in FIG. 11(*b*), the fixing mechanism 54 is provided on the downstream side of the platen 51 in the transport direction of the recording medium R, and the ink is jetted by the head 52 under the condition that the ink is sucked and held by the platen 51, and onto the print surface of the recording medium R transported by the transport roller 50, various operations may also be applied from the fixing mechanism 54. Hereupon, the various operations from the fixing mechanism means, for example, the radiation by the infrared ray, the heat transfer by the heater, or the drying by the hot air. In this case, the ink jetted onto the recording medium R can be fixed onto the recording medium R at soon.

[Effect of the Invention]

According to the present invention, in the printing in which the background color is, for example, the special color such as the white color, the bottom face printing can be selectively conducted, for example, onto the transparent recording medium, further, the top face printing can be selectively conducted as usual corresponding to for example, opaque various recording media. Thereby, the printing can be conducted corresponding to various recording media on a case-by-case basis, and also to the transparent or opaque resin made package material, the printing can be conducted correspondingly on a case-by-case basis.

What is claimed:

1. An inkjet printer comprising:

at least one special color head to jet a special color ink as a background color;

a plurality of process color heads to jet respective process color inks; and a controller to control operations of the special color head and the plurality of process color heads;

wherein the controller selectively controls the inkjet printer to conduct: (i) a top face printing, when printing on an obverse side of a recording medium, in which at least one of the plurality of the process color heads jets the respective process color ink after the special color head jets the special color ink on the obverse side of a recording medium, and (ii) a bottom face printing, when printing on an underside of a transparent or translucent recording medium, in which the special color head jets the special color ink after at least one of the plurality of the process color heads jets the respective process color ink on the underside of the transparent or translucent recording medium.

2. The inkjet printer of claim 1, wherein the at least one special color head comprises two special color heads;

wherein the inkjet printer further comprises a single carriage which is movable and on which the two special color heads and the plurality of the process color heads are mounted; and wherein the two special color heads are arranged at respective mutually separated positions on the single carriage, and the plurality of the process color heads are arranged between the two special color heads.

3. The inkjet printer of claim 2, wherein the positions of the special color heads are spaced along a movement direction of the single carriage.

4. The inkjet printer of claim 2, wherein the controller conducts a switching control for each of the two special color heads to jet the special ink, according to which of the top face printing and bottom face printing is conducted.

5. The inkjet printer of claim 2, wherein the controller controls two-way printing such that each of the special color heads or the plurality of process color heads jets the respective ink during a movement of the single carriage in an outward direction and also during a movement of the single carriage in a homeward direction; and wherein the controller conducts a switching control for each of the special color heads to jet the special ink, according to which of the top face printing and the bottom face printing is conducted, and according to which of the outward direction and the homeward direction is a movement direction of the carriage.

6. The inkjet printer of claim 1, wherein each of the special color ink jetted from the special color head and the respective process color inks jetted from the plurality of process color heads is jetted as an ink drop, and a jetted amount per one drop of the ink jetted from the special color head is greater than a jetted amount per one drop of the ink jetted from each of the process color heads.

7. The inkjet printer of claim 1, wherein the special color ink and each process color ink are one of aqueous ink, oil-based ink, solvent ink, and solid ink.

8. The inkjet printer of claim 1, wherein the special color head is a white color head and the special color ink is a white color ink.

* * * * *